US010231591B2

(12) United States Patent
Wennerström et al.

(10) Patent No.: US 10,231,591 B2
(45) Date of Patent: Mar. 19, 2019

(54) DUST CONTAINER

(71) Applicant: Aktiebolaget Electrolux, Stockholm (SE)

(72) Inventors: Magnus Wennerström, Stockholm (SE); Bänkt Andersson, Handen (SE)

(73) Assignee: Aktiebolaget Electrolux (SE)

( * ) Notice: Subject to any disclaimer, the term of this patent is extended or adjusted under 35 U.S.C. 154(b) by 332 days.

(21) Appl. No.: 15/102,295

(22) PCT Filed: Dec. 20, 2013

(86) PCT No.: PCT/EP2013/077661

§ 371 (c)(1),
(2) Date: Jun. 7, 2016

(87) PCT Pub. No.: WO2015/090439

PCT Pub. Date: Jun. 25, 2015

(65) Prior Publication Data

US 2017/0020355 A1 Jan. 26, 2017

(51) Int. Cl.

| | |
|---|---|
| ***A47L 9/10*** | (2006.01) |
| ***A47L 11/40*** | (2006.01) |
| ***A47L 9/12*** | (2006.01) |
| ***A47L 9/14*** | (2006.01) |

(52) U.S. Cl.

CPC ..... *A47L 11/4013* (2013.01); *A47L 9/122* (2013.01); *A47L 9/1409* (2013.01); *A47L 11/4011* (2013.01); *A47L 11/4027* (2013.01); *A47L 11/4041* (2013.01); *A47L 2201/00* (2013.01); *A47L 2201/04* (2013.01)

(58) Field of Classification Search

CPC ..... A47L 11/4013; A47L 11/4011; A47L 11/4041; A47L 11/4027; A47L 9/1409; A47L 9/122; A47L 2201/04; A47L 9/10

USPC ..... 15/347

See application file for complete search history.

(56) References Cited

U.S. PATENT DOCUMENTS

| | | | |
|---|---|---|---|
| 1,286,321 | A | 12/1918 | Hoover |
| 1,401,007 | A | 12/1921 | Staples |
| 3,010,129 | A | 11/1961 | Moore |
| 3,233,274 | A | 2/1966 | Kroll |
| 3,550,714 | A | 12/1970 | Bellinger |

(Continued)

FOREIGN PATENT DOCUMENTS

| | | |
|---|---|---|
| CA | 2154758 | 6/1995 |
| CN | 1116818 | 2/1996 |

(Continued)

OTHER PUBLICATIONS

Chinese Office Action for Chinese Application No. 201380075503.9, dated Nov. 8, 2017 with translation, 16 pages.

(Continued)

*Primary Examiner* — David Redding
(74) *Attorney, Agent, or Firm* — RatnerPrestia

(57) ABSTRACT

A dust container for an autonomous cleaner. The dust container includes: a container wall enclosing a dust chamber; a first side; a second side; an inlet opening to the dust chamber for dust particles and air arranged in the first side of the container; an outlet opening from the dust chamber for air arranged in the second side of the dust container; and a filter arranged in the dust container such that the flow of air through the dust container pass through the filter. Also provided is an autonomous cleaner having the dust container.

18 Claims, 3 Drawing Sheets

(56) References Cited

U.S. PATENT DOCUMENTS

| | | | |
|---|---|---|---|
| 3,570,227 | A | 3/1971 | Bellinger |
| 3,713,505 | A | 1/1973 | Muller |
| 3,837,028 | A | 9/1974 | Bridge |
| 4,028,765 | A | 6/1977 | Liebscher |
| 4,036,147 | A | 7/1977 | Westling |
| 4,114,711 | A | 9/1978 | Wilkins |
| 4,119,900 | A | 10/1978 | Kremnitz |
| 4,306,174 | A | 12/1981 | Mourier |
| 4,306,329 | A | 12/1981 | Yokoi |
| 4,369,543 | A | 1/1983 | Chen |
| 4,502,173 | A | 3/1985 | Patzold |
| 4,627,511 | A | 12/1986 | Yajima |
| 4,647,209 | A | 3/1987 | Neukomm |
| 4,800,978 | A | 1/1989 | Wasa |
| 4,822,450 | A | 4/1989 | Davis |
| 4,825,091 | A | 4/1989 | Breyer |
| 4,836,905 | A | 6/1989 | Davis |
| 4,838,990 | A | 6/1989 | Jucha |
| 4,842,686 | A | 6/1989 | Davis |
| 4,849,067 | A | 7/1989 | Jucha |
| 4,854,000 | A | 8/1989 | Takimoto |
| 4,864,511 | A | 9/1989 | Moy |
| 4,872,938 | A | 10/1989 | Davis |
| 4,878,003 | A | 10/1989 | Knepper |
| 4,886,570 | A | 12/1989 | Davis |
| 4,918,607 | A | 4/1990 | Wible |
| 4,919,224 | A | 4/1990 | Shyu |
| 4,922,559 | A | 5/1990 | Wall |
| 4,959,192 | A | 9/1990 | Trundle |
| 4,962,453 | A | 10/1990 | Pong |
| 4,989,818 | A | 2/1991 | Trundle |
| 5,001,635 | A | 3/1991 | Yasutomi |
| 5,006,302 | A | 4/1991 | Trundle |
| 5,023,444 | A | 6/1991 | Ohman |
| 5,032,775 | A | 7/1991 | Mizuno |
| 5,034,673 | A | 7/1991 | Shoji |
| 5,042,861 | A | 8/1991 | Trundle |
| 5,045,118 | A | 9/1991 | Mason |
| 5,086,535 | A | 2/1992 | Grossmeyer |
| 5,095,577 | A | 3/1992 | Jonas |
| 5,107,946 | A | 4/1992 | Kamimura |
| 5,155,683 | A | 10/1992 | Rahim |
| 5,243,732 | A | 9/1993 | Koharagi |
| 5,245,177 | A | 9/1993 | Schiller |
| 5,276,933 | A | 1/1994 | Hennessey |
| 5,279,672 | A | 1/1994 | Betker |
| 5,293,955 | A | 3/1994 | Lee |
| 5,307,273 | A | 4/1994 | Oh |
| 5,309,592 | A | 5/1994 | Hiratsuka |
| 5,341,540 | A | 8/1994 | Soupert |
| 5,345,639 | A | 9/1994 | Tanoue |
| 5,349,378 | A | 9/1994 | FereydounMaali |
| 5,353,224 | A | 10/1994 | Lee |
| 5,367,458 | A | 11/1994 | Roberts et al. |
| 5,369,347 | A | 11/1994 | Yoo |
| 5,377,106 | A | 12/1994 | Drunk |
| 5,390,627 | A | 2/1995 | van der Berg |
| 5,398,632 | A | 3/1995 | Goldbach |
| 5,402,051 | A | 3/1995 | Fujiwara |
| 5,440,216 | A | 8/1995 | Kim |
| 5,444,965 | A | 8/1995 | Colens |
| 5,446,356 | A | 8/1995 | Kim |
| 5,454,129 | A | 10/1995 | Kell |
| 5,518,552 | A | 5/1996 | Tanoue |
| 5,534,762 | A | 7/1996 | Kim |
| 5,548,511 | A | 8/1996 | Bancroft |
| 5,560,077 | A | 10/1996 | Crotchett |
| 5,568,589 | A | 10/1996 | Hwang |
| 5,621,291 | A | 4/1997 | Lee |
| 5,646,494 | A | 7/1997 | Han |
| 5,666,689 | A | 9/1997 | Andersen |
| 5,682,313 | A | 10/1997 | Edlund |
| 5,682,640 | A | 11/1997 | Han |
| 5,687,294 | A | 11/1997 | Jeong |
| 5,698,957 | A | 12/1997 | Sowada |
| 5,745,946 | A | 5/1998 | Thrasher |
| 5,758,298 | A | 5/1998 | Guldner |
| 5,778,554 | A | 7/1998 | Jones |
| 5,781,960 | A | 7/1998 | Kilstrom |
| 5,787,545 | A | 8/1998 | Colens |
| 5,815,880 | A | 10/1998 | Nakanishi |
| 5,825,981 | A | 10/1998 | Matsuda |
| 5,841,259 | A | 11/1998 | Kim |
| 5,852,984 | A | 12/1998 | Matsuyama |
| 5,867,800 | A | 2/1999 | Leif |
| 5,890,250 | A | 4/1999 | Lange |
| 5,896,488 | A | 4/1999 | Jeong |
| 5,903,124 | A | 5/1999 | YuichiKawakami |
| 5,926,909 | A | 7/1999 | McGee |
| 5,933,902 | A | 8/1999 | Frey |
| 5,935,179 | A | 8/1999 | Kleiner |
| 5,940,927 | A | 8/1999 | Haegermarck |
| 5,942,869 | A | 8/1999 | Katou |
| 5,947,051 | A | 9/1999 | Geiger |
| 5,959,423 | A | 9/1999 | Nakanishi |
| 5,959,424 | A | 9/1999 | Elkmann |
| 5,966,765 | A | 10/1999 | Hamada |
| RE36,391 | E | 11/1999 | vandenBerg |
| 5,983,833 | A | 11/1999 | van der Lely |
| 5,987,696 | A | 11/1999 | Wang |
| 5,991,951 | A | 11/1999 | Kubo |
| 5,995,884 | A | 11/1999 | Allen |
| 5,997,670 | A | 12/1999 | Walter |
| 5,999,865 | A | 12/1999 | Bloomquist et al. |
| 6,012,470 | A | 1/2000 | Jones |
| 6,024,107 | A | 2/2000 | Jones |
| 6,064,926 | A | 5/2000 | Sarangapani |
| 6,076,662 | A | 6/2000 | Bahten |
| 6,082,377 | A | 7/2000 | Frey |
| 6,124,694 | A | 9/2000 | Bancroft |
| 6,142,252 | A | 11/2000 | Kinto |
| 6,176,067 | B1 | 1/2001 | Bahten |
| 6,213,136 | B1 | 4/2001 | Jones |
| 6,226,830 | B1 | 5/2001 | Hendriks |
| 6,230,360 | B1 | 5/2001 | Singleton |
| 6,251,551 | B1 | 6/2001 | Kunze-Concewitz |
| 6,255,793 | B1 | 7/2001 | Peless |
| 6,263,989 | B1 | 7/2001 | Won |
| 6,300,737 | B1 | 10/2001 | Bergvall |
| 6,311,366 | B1 | 11/2001 | Sepke |
| 6,327,741 | B1 | 12/2001 | Reed |
| 6,339,735 | B1 | 1/2002 | Peless |
| 6,358,325 | B1 | 3/2002 | Andreas |
| 6,360,801 | B1 | 3/2002 | Walter |
| 6,370,452 | B1 | 4/2002 | Pfister |
| 6,370,453 | B2 | 4/2002 | Sommer |
| 6,381,801 | B1 | 5/2002 | Clemons, Sr. |
| 6,389,329 | B1 | 5/2002 | Colens |
| 6,413,149 | B1 | 7/2002 | Wada |
| 6,417,641 | B2 | 7/2002 | Peless |
| 6,431,296 | B1 | 8/2002 | Won |
| 6,438,456 | B1 | 8/2002 | Feddema |
| 6,443,509 | B1 | 9/2002 | Levin |
| 6,457,199 | B1 | 10/2002 | Frost |
| 6,457,206 | B1 | 10/2002 | Judson |
| 6,459,955 | B1 | 10/2002 | Bartsch |
| 6,465,982 | B1 | 10/2002 | Bergvall |
| 6,481,515 | B1 | 11/2002 | Kirkpatrick |
| 6,482,678 | B1 | 11/2002 | Frost |
| 6,493,612 | B1 | 12/2002 | Bisset |
| 6,493,613 | B2 | 12/2002 | Peless |
| 6,496,754 | B2 | 12/2002 | Song |
| 6,504,610 | B1 | 1/2003 | Bauer |
| 6,519,804 | B1 | 2/2003 | Vujik |
| 6,525,509 | B1 | 2/2003 | Petersson |
| D471,243 | S | 3/2003 | Cioffi |
| 6,532,404 | B2 | 3/2003 | Colens |
| 6,535,793 | B2 | 3/2003 | Allard |
| 6,571,415 | B2 | 6/2003 | Gerber |
| 6,580,246 | B2 | 6/2003 | Jacobs |
| 6,581,239 | B1 | 6/2003 | Dyson |
| 6,594,844 | B2 | 7/2003 | Jones |
| 6,597,143 | B2 | 7/2003 | Song |
| 6,601,265 | B1 | 8/2003 | Burlington |

(56) References Cited

U.S. PATENT DOCUMENTS 6,605,156 B1 8/2003 Clark
6,609,962 B1 8/2003 Wakabayashi
6,611,120 B2 8/2003 Song
6,611,318 B2 8/2003 LaPolice
6,615,108 B1 9/2003 Peless
6,615,885 B1 9/2003 Ohm
6,633,150 B1 10/2003 Wallach
6,637,446 B2 10/2003 Frost
6,658,325 B2 12/2003 Zweig
6,661,239 B1 12/2003 Ozick
6,662,889 B2 12/2003 De Fazio
6,667,592 B2 12/2003 Jacobs
6,668,951 B2 12/2003 Won
6,671,592 B1 12/2003 Bisset
6,690,134 B1 2/2004 Jones
6,726,823 B1 4/2004 Wang
6,732,826 B2 5/2004 Song
6,745,431 B2 6/2004 Dijksman
6,748,297 B2 6/2004 Song
6,769,004 B2 7/2004 Barrett
6,774,596 B1 8/2004 Bisset
6,775,871 B1 8/2004 Finch
6,781,338 B2 8/2004 Jones
6,809,490 B2 10/2004 Jones
6,810,305 B2 10/2004 Kirkpatrick, Jr.
6,820,801 B2 11/2004 Kaneko
6,841,963 B2 1/2005 Song
6,845,297 B2 1/2005 Allard
6,850,024 B2 2/2005 Peless
6,859,010 B2 2/2005 Jeon
6,859,976 B2 3/2005 Plankenhorn
6,860,206 B1 3/2005 Rudakevych
6,868,307 B2 3/2005 Song
6,869,633 B2 3/2005 Sus
6,870,792 B2 3/2005 Chiappetta
6,882,334 B1 4/2005 Meyer
6,883,201 B2 4/2005 Jones
6,885,912 B2 4/2005 Peless
6,901,624 B2 6/2005 Mori
6,925,679 B2 8/2005 Wallach
D510,066 S 9/2005 Hickey
6,938,298 B2 9/2005 Aasen
6,939,208 B2 9/2005 Kamimura
6,940,291 B1 9/2005 Ozick
6,941,199 B1 9/2005 Bottomley
6,942,548 B2 9/2005 Wada
6,956,348 B2 10/2005 Landry
6,957,712 B2 10/2005 Song
6,964,312 B2 11/2005 Maggio
6,965,209 B2 11/2005 Jones
6,967,275 B2 11/2005 Ozick
6,971,140 B2 12/2005 Kim
6,971,141 B1 12/2005 Tak
6,984,952 B2 1/2006 Peless
7,000,623 B2 2/2006 Welsh
7,004,269 B2 2/2006 Song
7,013,200 B2 3/2006 Wakui
7,013,527 B2 3/2006 Thomas, Sr.
7,015,831 B2 3/2006 Karlsson
7,024,278 B2 4/2006 Chiappetta
7,031,805 B2 4/2006 Lee
7,040,968 B2 5/2006 Kamimura
7,042,342 B2 5/2006 Luo
7,043,794 B2 5/2006 Conner
7,050,926 B2 5/2006 Theurer et al.
7,053,578 B2 5/2006 Diehl et al.
7,053,580 B2 5/2006 Aldred
7,054,716 B2 5/2006 McKee
7,059,012 B2 6/2006 Song
7,079,923 B2 7/2006 Abramson
7,082,350 B2 7/2006 Skoog
D526,753 S 8/2006 Tani
7,085,624 B2 8/2006 Aldred
7,103,449 B2 9/2006 Woo
7,113,847 B2 9/2006 Chmura
7,117,067 B2 10/2006 McLurkin
7,133,745 B2 11/2006 Wang
7,134,164 B2 11/2006 Alton
7,135,992 B2 11/2006 Karlsson
7,143,696 B2 12/2006 Rudakevych
7,145,478 B2 12/2006 Goncalves
7,150,068 B1 12/2006 Ragner
7,155,308 B2 12/2006 Jones
7,155,309 B2 12/2006 Peless
7,162,338 B2 1/2007 Goncalves
7,167,775 B2 1/2007 Abramson
7,173,391 B2 2/2007 Jones
7,174,238 B1 2/2007 Zweig
7,177,737 B2 2/2007 Karlsson
7,184,586 B2 2/2007 Jeon
7,185,396 B2 3/2007 Im
7,185,397 B2 3/2007 Stuchlik
7,188,000 B2 3/2007 Chiappetta
7,196,487 B2 3/2007 Jones
7,199,711 B2 4/2007 Field
7,200,892 B2 4/2007 Kim
7,202,630 B2 4/2007 Dan
7,206,677 B2 4/2007 Hulden
7,207,081 B2 4/2007 Gerber
7,208,892 B2 4/2007 Tondra
7,213,298 B2 5/2007 Cipolla
7,213,663 B2 5/2007 Kim
7,222,390 B2 5/2007 Cipolla
7,225,500 B2 6/2007 Diehl
7,237,298 B2 7/2007 Reindle
7,240,396 B2 7/2007 Thomas, Sr.
7,246,405 B2 7/2007 Yan
7,248,951 B2 7/2007 Hulden
7,251,853 B2 8/2007 Park
7,254,464 B1 8/2007 McLurkin
7,254,859 B2 8/2007 Gerber
7,269,877 B2 9/2007 Tondra
7,272,467 B2 9/2007 Goncalves
7,272,868 B2 9/2007 Im
7,274,167 B2 9/2007 Kim
7,275,280 B2 10/2007 Haegermarck
7,288,912 B2 10/2007 Landry
D556,961 S 12/2007 Swyst
7,303,776 B2 12/2007 Sus
7,324,870 B2 1/2008 Lee
7,331,436 B1 2/2008 Pack
7,332,890 B2 2/2008 Cohen
7,343,221 B2 3/2008 Ann
7,343,719 B2 3/2008 Sus
7,346,428 B1 3/2008 Huffman
7,349,759 B2 3/2008 Peless
7,359,766 B2 4/2008 Jeon
7,363,994 B1 4/2008 DeFazio
7,369,460 B2 5/2008 Chiappetta
7,372,004 B2 5/2008 Buchner
7,388,343 B2 6/2008 Jones
7,389,156 B2 6/2008 Ziegler
7,389,166 B2 6/2008 Harwig
7,403,360 B2 7/2008 Cunningham
7,412,748 B2 8/2008 Lee
7,417,404 B2 8/2008 Lee
7,418,762 B2 9/2008 Arai
7,424,766 B2 9/2008 Reindle
7,429,843 B2 9/2008 Jones
7,430,455 B2 9/2008 Casey
7,438,766 B2 10/2008 Song
7,441,298 B2 10/2008 Svendsen
7,444,206 B2 10/2008 Abramson
7,448,113 B2 11/2008 Jones
7,459,871 B2 12/2008 Landry
7,464,157 B2 12/2008 Okude
7,474,941 B2 1/2009 Kim
7,480,958 B2 1/2009 Song
7,480,960 B2 1/2009 Kim
D586,959 S 2/2009 Geringer
7,489,277 B2 2/2009 Sung
7,489,985 B2 2/2009 Ko
7,499,774 B2 3/2009 Barrett
7,499,775 B2 3/2009 Filippov

(56) References Cited

U.S. PATENT DOCUMENTS

| | | | |
|---|---|---|---|
| 7,499,776 | B2 | 3/2009 | Allard |
| 7,499,804 | B2 | 3/2009 | Svendsen |
| 7,503,096 | B2 | 3/2009 | Lin |
| 7,515,991 | B2 | 4/2009 | Egawa |
| D593,265 | S | 5/2009 | Carr |
| 7,539,557 | B2 | 5/2009 | Yamauchi |
| 7,546,891 | B2 | 6/2009 | Won |
| 7,546,912 | B1 | 6/2009 | Pack |
| 7,555,363 | B2 | 6/2009 | Augenbraun |
| 7,556,108 | B2 | 7/2009 | Won |
| 7,559,269 | B2 | 7/2009 | Rudakevych |
| 7,564,571 | B2 | 7/2009 | Karabassi |
| 7,566,839 | B2 | 7/2009 | Hukuba |
| 7,567,052 | B2 | 7/2009 | Jones |
| 7,568,259 | B2 | 8/2009 | Yan |
| 7,568,536 | B2 | 8/2009 | Yu |
| 7,571,511 | B2 | 8/2009 | Jones |
| 7,573,403 | B2 | 8/2009 | Goncalves |
| 7,574,282 | B2 | 8/2009 | Petersson |
| 7,578,020 | B2 | 8/2009 | Jaworski |
| 7,579,803 | B2 | 8/2009 | Jones |
| 7,581,282 | B2 | 9/2009 | Woo |
| 7,597,162 | B2 | 10/2009 | Won |
| 7,600,521 | B2 | 10/2009 | Woo |
| 7,600,593 | B2 | 10/2009 | Filippov |
| 7,603,744 | B2 | 10/2009 | Reindle |
| 7,604,675 | B2 | 10/2009 | Makarov |
| 7,610,651 | B2 | 11/2009 | Baek |
| 7,613,543 | B2 | 11/2009 | Petersson |
| 7,620,476 | B2 | 11/2009 | Morse |
| 7,636,982 | B2 | 12/2009 | Jones |
| 7,647,144 | B2 | 1/2010 | Haegermarck |
| 7,650,666 | B2 | 1/2010 | Jang |
| 7,654,348 | B2 | 2/2010 | Ohm |
| 7,660,650 | B2 | 2/2010 | Kawagoe |
| 7,663,333 | B2 | 2/2010 | Jones |
| 7,673,367 | B2 | 3/2010 | Kim |
| 7,679,532 | B2 | 3/2010 | Karlsson |
| 7,688,676 | B2 | 3/2010 | Chiappetta |
| 7,693,654 | B1 | 4/2010 | Dietsch |
| 7,697,141 | B2 | 4/2010 | Jones |
| 7,706,917 | B1 | 4/2010 | Chiappetta |
| 7,706,921 | B2 | 4/2010 | Jung |
| 7,709,497 | B2 | 5/2010 | Christensen, IV |
| 7,711,450 | B2 | 5/2010 | Im |
| 7,720,572 | B2 | 5/2010 | Ziegler |
| 7,721,829 | B2 | 5/2010 | Lee |
| 7,729,801 | B2 | 6/2010 | Abramson |
| 7,749,294 | B2 | 7/2010 | Oh |
| 7,751,940 | B2 | 7/2010 | Lee |
| 7,761,954 | B2 | 7/2010 | Ziegler |
| 7,765,635 | B2 | 8/2010 | Park |
| 7,765,638 | B2 | 8/2010 | Pineschi et al. |
| 7,769,490 | B2 | 8/2010 | Abramson |
| 7,774,158 | B2 | 8/2010 | Domingues Goncalves |
| 7,779,504 | B2 | 8/2010 | Lee |
| 7,780,796 | B2 | 8/2010 | Shim |
| 7,784,139 | B2 | 8/2010 | Sawalski |
| 7,784,570 | B2 | 8/2010 | Couture |
| 7,785,544 | B2 | 8/2010 | Alward |
| 7,787,991 | B2 | 8/2010 | Jeung |
| 7,793,614 | B2 | 9/2010 | Ericsson |
| 7,801,645 | B2 | 9/2010 | Taylor |
| 7,805,220 | B2 | 9/2010 | Taylor |
| 7,827,653 | B1 | 11/2010 | Liu |
| 7,832,048 | B2 | 11/2010 | Harwig |
| 7,835,529 | B2 | 11/2010 | Hernandez |
| 7,843,431 | B2 | 11/2010 | Robbins |
| 7,844,364 | B2 | 11/2010 | McLurkin |
| 7,849,555 | B2 | 12/2010 | Hahm |
| 7,856,291 | B2 | 12/2010 | Jung |
| 7,860,608 | B2 | 12/2010 | Lee |
| 7,861,365 | B2 | 1/2011 | Sun |
| 7,861,366 | B2 | 1/2011 | Hahm |
| 7,873,437 | B2 | 1/2011 | Aldred |
| 7,877,166 | B2 | 1/2011 | Harwig |
| 7,886,399 | B2 | 2/2011 | Dayton |
| 7,890,210 | B2 | 2/2011 | Choi |
| 7,891,045 | B2 | 2/2011 | Kim |
| 7,891,289 | B2 | 2/2011 | Day |
| 7,891,446 | B2 | 2/2011 | Couture |
| 7,894,951 | B2 | 2/2011 | Norris |
| 7,916,931 | B2 | 3/2011 | Lee |
| 7,920,941 | B2 | 4/2011 | Park |
| 7,921,506 | B2 | 4/2011 | Baek |
| 7,926,598 | B2 | 4/2011 | Rudakevych |
| 7,934,571 | B2 | 5/2011 | Chiu |
| 7,937,800 | B2 | 5/2011 | Yan |
| 7,942,107 | B2 | 5/2011 | Vosburgh |
| 7,957,837 | B2 | 6/2011 | Ziegler |
| 7,962,997 | B2 | 6/2011 | Chung |
| 7,966,339 | B2 | 6/2011 | Kim |
| 7,975,790 | B2 | 7/2011 | Kim |
| 7,979,175 | B2 | 7/2011 | Allard |
| 7,979,945 | B2 | 7/2011 | Dayton |
| 7,981,455 | B2 | 7/2011 | Sus |
| 7,997,118 | B2 | 8/2011 | Mecca |
| 8,001,651 | B2 | 8/2011 | Chang |
| 8,007,221 | B1 | 8/2011 | More |
| 8,010,229 | B2 | 8/2011 | Kim |
| 8,019,223 | B2 | 9/2011 | Hudson |
| 8,020,657 | B2 | 9/2011 | Allard |
| 8,032,978 | B2 | 10/2011 | Haegermarck |
| 8,034,390 | B2 | 10/2011 | Sus |
| 8,042,663 | B1 | 10/2011 | Pack |
| 8,046,103 | B2 | 10/2011 | Abramson |
| 8,061,461 | B2 | 11/2011 | Couture |
| 8,065,778 | B2 | 11/2011 | Kim |
| 8,073,439 | B2 | 12/2011 | Stromberg |
| 8,074,752 | B2 | 12/2011 | Rudakevych |
| 8,078,338 | B2 | 12/2011 | Pack |
| 8,079,432 | B2 | 12/2011 | Ohm |
| 8,082,836 | B2 | 12/2011 | More |
| 8,086,419 | B2 | 12/2011 | Goncalves |
| 8,087,117 | B2 | 1/2012 | Kapoor |
| 8,095,238 | B2 | 1/2012 | Jones |
| 8,095,336 | B2 | 1/2012 | Goncalves |
| 8,107,318 | B2 | 1/2012 | Chiappetta |
| 8,108,092 | B2 | 1/2012 | Phillips |
| 8,109,191 | B1 | 2/2012 | Rudakevych |
| 8,112,942 | B2 | 2/2012 | Bohm |
| 8,113,304 | B2 | 2/2012 | Won |
| 8,122,982 | B2 | 2/2012 | Morey |
| 8,127,396 | B2 | 3/2012 | Mangiardi |
| 8,127,399 | B2 | 3/2012 | Dilger |
| 8,127,704 | B2 | 3/2012 | Vosburgh |
| 8,136,200 | B2 | 3/2012 | Splinter |
| 8,150,650 | B2 | 4/2012 | Goncalves |
| D659,311 | S | 5/2012 | Geringer |
| 8,166,904 | B2 | 5/2012 | Israel |
| 8,195,333 | B2 | 6/2012 | Ziegler |
| 8,196,251 | B2 | 6/2012 | Lynch |
| 8,199,109 | B2 | 6/2012 | Robbins |
| 8,200,600 | B2 | 6/2012 | Rosenstein |
| 8,200,700 | B2 | 6/2012 | Moore |
| 8,237,389 | B2 | 8/2012 | Fitch |
| 8,237,920 | B2 | 8/2012 | Jones |
| 8,239,992 | B2 | 8/2012 | Schnittman |
| 8,244,469 | B2 | 8/2012 | Cheung |
| 8,253,368 | B2 | 8/2012 | Landry |
| 8,255,092 | B2 | 8/2012 | Phillips |
| 8,256,542 | B2 | 9/2012 | Couture |
| 8,265,793 | B2 | 9/2012 | Cross |
| 8,274,406 | B2 | 9/2012 | Karlsson |
| 8,281,703 | B2 | 10/2012 | Moore |
| 8,281,731 | B2 | 10/2012 | Vosburgh |
| 8,290,619 | B2 | 10/2012 | McLurkin |
| 8,292,007 | B2 | 10/2012 | DeFazio |
| 8,295,125 | B2 | 10/2012 | Chiappetta |
| D670,877 | S | 11/2012 | Geringer |
| 8,308,529 | B2 | 11/2012 | DAmbra |
| 8,311,674 | B2 | 11/2012 | Abramson |
| 8,316,971 | B2 | 11/2012 | Couture |
| 8,318,499 | B2 | 11/2012 | Fritchie |

(56) References Cited

U.S. PATENT DOCUMENTS

| | | | |
|---|---|---|---|
| D672,928 | S | 12/2012 | Swett |
| 8,322,470 | B2 | 12/2012 | Ohm |
| 8,326,469 | B2 | 12/2012 | Phillips |
| 8,327,960 | B2 | 12/2012 | Couture |
| 8,336,479 | B2 | 12/2012 | Vosburgh |
| 8,342,271 | B2 | 1/2013 | Filippov |
| 8,347,088 | B2 | 1/2013 | Moore |
| 8,347,444 | B2 | 1/2013 | Schnittman |
| 8,350,810 | B2 | 1/2013 | Robbins |
| 8,353,373 | B2 | 1/2013 | Rudakevych |
| 8,364,309 | B1 | 1/2013 | Bailey |
| 8,364,310 | B2 | 1/2013 | Jones |
| 8,365,848 | B2 | 2/2013 | Won |
| 8,368,339 | B2 | 2/2013 | Jones |
| 8,370,985 | B2 | 2/2013 | Schnittman |
| 8,374,721 | B2 | 2/2013 | Halloran |
| 8,375,838 | B2 | 2/2013 | Rudakevych |
| 8,378,613 | B2 | 2/2013 | Landry |
| 8,380,350 | B2 | 2/2013 | Ozick |
| 8,382,906 | B2 | 2/2013 | Konandreas |
| 8,386,081 | B2 | 2/2013 | Landry |
| 8,387,193 | B2 | 3/2013 | Ziegler |
| 8,390,251 | B2 | 3/2013 | Cohen |
| 8,392,021 | B2 | 3/2013 | Konandreas |
| 8,396,592 | B2 | 3/2013 | Jones |
| 8,396,611 | B2 | 3/2013 | Phillips |
| 8,402,586 | B2 | 3/2013 | Lavabre |
| 8,408,956 | B1 | 4/2013 | Vosburgh |
| 8,412,377 | B2 | 4/2013 | Casey |
| 8,413,752 | B2 | 4/2013 | Page |
| 8,417,188 | B1 | 4/2013 | Vosburgh |
| 8,417,383 | B2 | 4/2013 | Ozick |
| 8,418,303 | B2 | 4/2013 | Kapoor |
| 8,418,642 | B2 | 4/2013 | Vosburgh |
| 8,428,778 | B2 | 4/2013 | Landry |
| 8,433,442 | B2 | 4/2013 | Friedman |
| D682,362 | S | 5/2013 | Mozeika |
| 8,438,694 | B2 | 5/2013 | Kim |
| 8,438,695 | B2 | 5/2013 | Gilbert, Jr. |
| 8,438,698 | B2 | 5/2013 | Kim |
| 8,447,440 | B2 | 5/2013 | Phillips |
| 8,447,613 | B2 | 5/2013 | Hussey |
| 8,452,448 | B2 | 5/2013 | Pack |
| 8,453,289 | B2 | 6/2013 | Lynch |
| 8,456,125 | B2 | 6/2013 | Landry |
| 8,461,803 | B2 | 6/2013 | Cohen |
| 8,463,438 | B2 | 6/2013 | Jones |
| 8,473,140 | B2 | 6/2013 | Norris |
| 8,474,090 | B2 | 7/2013 | Jones |
| 8,478,442 | B2 | 7/2013 | Casey |
| 8,485,330 | B2 | 7/2013 | Pack |
| 8,505,158 | B2 | 8/2013 | Han |
| 8,508,388 | B2 | 8/2013 | Karlsson |
| 8,515,578 | B2 | 8/2013 | Chiappetta |
| 8,516,651 | B2 | 8/2013 | Jones |
| 8,525,995 | B2 | 9/2013 | Jones |
| 8,527,113 | B2 | 9/2013 | Yamauchi |
| 8,528,157 | B2 | 9/2013 | Schnittman |
| 8,528,162 | B2 | 9/2013 | Tang |
| 8,528,673 | B2 | 9/2013 | More |
| 8,532,822 | B2 | 9/2013 | Abramson |
| 8,533,144 | B1 | 9/2013 | Reeser |
| 8,534,983 | B2 | 9/2013 | Schoenfeld |
| 8,543,562 | B2 | 9/2013 | Mule |
| 8,548,626 | B2 | 10/2013 | Steitz |
| 8,551,254 | B2 | 10/2013 | Dayton |
| 8,551,421 | B2 | 10/2013 | Luchinger |
| 8,565,920 | B2 | 10/2013 | Casey |
| 8,572,799 | B2 | 11/2013 | Won |
| 8,584,305 | B2 | 11/2013 | Won |
| 8,584,306 | B2 | 11/2013 | Chung |
| 8,584,307 | B2 | 11/2013 | Won |
| 8,594,840 | B1 | 11/2013 | Chiappetta |
| 8,598,829 | B2 | 12/2013 | Landry |
| 8,599,645 | B2 | 12/2013 | Chiappetta |
| 8,600,553 | B2 | 12/2013 | Svendsen |
| 8,606,401 | B2 | 12/2013 | Ozick |
| 8,634,956 | B1 | 1/2014 | Chiappetta |
| 8,634,958 | B1 | 1/2014 | Chiappetta |
| 8,666,523 | B2 | 3/2014 | Kim |
| 8,671,513 | B2 | 3/2014 | Yoo et al. |
| 8,732,895 | B2 | 5/2014 | Cunningham |
| 8,741,013 | B2 | 6/2014 | Swett et al. |
| 8,743,286 | B2 | 6/2014 | Hasegawa |
| 8,745,194 | B2 | 6/2014 | Uribe-Etxebarria Jimenez |
| 8,755,936 | B2 | 6/2014 | Friedman |
| 8,761,931 | B2 | 6/2014 | Halloran |
| 8,763,200 | B2 | 7/2014 | Kim |
| 8,774,970 | B2 | 7/2014 | Knopow |
| 8,798,791 | B2 | 8/2014 | Li |
| 8,798,792 | B2 | 8/2014 | Park |
| 8,799,258 | B2 | 8/2014 | Mule |
| 8,838,274 | B2 | 9/2014 | Jones |
| 8,839,477 | B2 | 9/2014 | Schnittman |
| 8,843,245 | B2 | 9/2014 | Choe |
| 8,855,914 | B1 | 10/2014 | Alexander |
| 8,874,264 | B1 | 10/2014 | Chiappetta |
| 8,881,339 | B2 | 11/2014 | Gilbert, Jr. et al. |
| 8,924,042 | B2 | 12/2014 | Kim |
| 8,961,695 | B2 | 2/2015 | Romanov |
| 8,985,127 | B2 | 3/2015 | Konandreas |
| 8,996,172 | B2 | 3/2015 | Shah et al. |
| 9,033,079 | B2 | 5/2015 | Shin |
| 9,037,396 | B2 | 5/2015 | Pack |
| 9,144,361 | B2 | 9/2015 | Landry |
| 9,360,300 | B2 | 6/2016 | EnricoDiBernado |
| 10,045,675 | B2 | 8/2018 | Haegermarck |
| 2001/0004719 | A1 | 6/2001 | Sommer |
| 2001/0037163 | A1 | 11/2001 | Allard |
| 2002/0016649 | A1 | 2/2002 | Jones |
| 2002/0091466 | A1 | 7/2002 | Song |
| 2002/0108635 | A1 | 8/2002 | Marrero |
| 2002/0121288 | A1 | 9/2002 | Marrero |
| 2002/0121561 | A1 | 9/2002 | Marrero |
| 2002/0164932 | A1 | 11/2002 | Kamimura |
| 2002/0174506 | A1 | 11/2002 | Wallach |
| 2002/0185071 | A1 | 12/2002 | Guo |
| 2002/0189871 | A1 | 12/2002 | Won |
| 2003/0000034 | A1 | 1/2003 | Welsh |
| 2003/0025472 | A1 | 2/2003 | Jones |
| 2003/0030398 | A1 | 2/2003 | Jacobs |
| 2003/0120972 | A1 | 6/2003 | Matsushima |
| 2003/0159223 | A1 | 8/2003 | Plankenhorn |
| 2003/0167000 | A1 | 9/2003 | Mullick |
| 2003/0229421 | A1 | 12/2003 | Chmura |
| 2004/0020000 | A1 | 2/2004 | Jones |
| 2004/0031111 | A1 | 2/2004 | Porchia |
| 2004/0031121 | A1 | 2/2004 | Martin |
| 2004/0034952 | A1 | 2/2004 | Ho |
| 2004/0049877 | A1 | 3/2004 | Jones |
| 2004/0049878 | A1 | 3/2004 | Thomas |
| 2004/0074038 | A1 | 4/2004 | Im |
| 2004/0074039 | A1 | 4/2004 | Kim |
| 2004/0098167 | A1 | 5/2004 | Yi |
| 2004/0111184 | A1 | 6/2004 | Chiappetta |
| 2004/0111827 | A1 | 6/2004 | Im |
| 2004/0167667 | A1 | 8/2004 | Goncalves |
| 2004/0181896 | A1 | 9/2004 | Egawa |
| 2004/0182839 | A1 | 9/2004 | Denney |
| 2004/0182840 | A1 | 9/2004 | Denney |
| 2004/0185011 | A1 | 9/2004 | Alexander |
| 2004/0187249 | A1 | 9/2004 | Jones |
| 2004/0207355 | A1 | 10/2004 | Jones |
| 2004/0208212 | A1 | 10/2004 | Denney |
| 2004/0210343 | A1 | 10/2004 | Kim |
| 2004/0220707 | A1 | 11/2004 | Pallister |
| 2005/0010331 | A1 | 1/2005 | Taylor |
| 2005/0015912 | A1 | 1/2005 | Kim |
| 2005/0015915 | A1 | 1/2005 | Thomas |
| 2005/0028315 | A1 | 2/2005 | Thomas |
| 2005/0028316 | A1 | 2/2005 | Thomas |
| 2005/0042151 | A1 | 2/2005 | Alward |
| 2005/0065662 | A1 | 3/2005 | Reindle |
| 2005/0085947 | A1 | 4/2005 | MichaelAldred |

(56) References Cited

U.S. PATENT DOCUMENTS

2005/0088643 A1 4/2005 Anderson
2005/0156562 A1 7/2005 Cohen
2005/0166354 A1 8/2005 NaoyaUehigashi
2005/0191949 A1 9/2005 Kamimura
2005/0217061 A1 10/2005 Reindle
2005/0223514 A1 10/2005 Stuchlik
2005/0229340 A1 10/2005 Sawalski
2005/0230166 A1 10/2005 Petersson
2005/0234611 A1 10/2005 Uehigashi
2005/0251292 A1 11/2005 Casey
2005/0251457 A1 11/2005 Kashiwagi
2005/0251947 A1 11/2005 Lee
2005/0267629 A1 12/2005 Petersson
2005/0278888 A1 12/2005 Reindle
2005/0287038 A1 12/2005 Dubrovsky
2006/0009879 A1 1/2006 Lynch
2006/0010799 A1 1/2006 Bohm
2006/0020369 A1 1/2006 Taylor
2006/0028306 A1 2/2006 Hukuba
2006/0032013 A1 2/2006 Kim
2006/0045981 A1 3/2006 Tsushi
2006/0095158 A1 5/2006 Lee
2006/0136096 A1 6/2006 Chiappetta
2006/0144834 A1 7/2006 Denney
2006/0178777 A1 8/2006 Park
2006/0190133 A1 8/2006 Konandreas
2006/0190134 A1 8/2006 Ziegler
2006/0190146 A1 8/2006 Morse
2006/0195015 A1 8/2006 Mullick
2006/0200281 A1 9/2006 Ziegler
2006/0213025 A1 9/2006 Sawalski
2006/0235570 A1 10/2006 Jung
2006/0235585 A1 10/2006 HirotoTanaka
2006/0236492 A1 10/2006 KazuyaSudo
2006/0288519 A1 12/2006 Jaworski
2006/0293788 A1 12/2006 Pogodin
2007/0016328 A1 1/2007 Ziegler
2007/0021867 A1 1/2007 Woo
2007/0059441 A1 3/2007 Greer
2007/0061040 A1 3/2007 Augenbraun et al.
2007/0114975 A1 5/2007 Cohen
2007/0118248 A1 5/2007 Lee et al.
2007/0124890 A1 6/2007 Erko
2007/0143950 A1 6/2007 Lin
2007/0156286 A1 7/2007 Yamauchi
2007/0179670 A1 8/2007 Chiappetta
2007/0189347 A1 8/2007 Denney
2007/0204426 A1 9/2007 Nakagawa
2007/0213892 A1 9/2007 Jones
2007/0214601 A1 9/2007 Chung
2007/0234492 A1 10/2007 Svendsen
2007/0244610 A1 10/2007 Ozick
2007/0266508 A1 11/2007 Jones
2007/0267230 A1 11/2007 Won
2007/0267570 A1 11/2007 Park
2007/0267998 A1 11/2007 Cohen
2007/0273864 A1 11/2007 Cho
2007/0276541 A1 11/2007 Sawasaki
2007/0285041 A1 12/2007 Jones
2007/0289267 A1 12/2007 Makarov
2007/0290649 A1 12/2007 Jones
2008/0000041 A1 1/2008 Jones
2008/0000042 A1 1/2008 Jones
2008/0001566 A1 1/2008 Jones
2008/0007203 A1 1/2008 Cohen
2008/0009964 A1 1/2008 Bruemmer et al.
2008/0015738 A1 1/2008 Casey
2008/0016631 A1 1/2008 Casey
2008/0037170 A1 2/2008 Saliba
2008/0039974 A1 2/2008 Sandin
2008/0047092 A1 2/2008 Schnittman
2008/0051953 A1 2/2008 Jones
2008/0007193 A1 3/2008 Bow
2008/0052846 A1 3/2008 Kapoor
2008/0058987 A1 3/2008 Ozick
2008/0063400 A1 3/2008 Hudson
2008/0065265 A1 3/2008 Ozick
2008/0077278 A1 3/2008 Park
2008/0084174 A1 4/2008 Jones
2008/0086241 A1 4/2008 Phillips
2008/0091304 A1 4/2008 Ozick
2008/0091305 A1 4/2008 Svendsen
2008/0093131 A1 4/2008 Couture
2008/0098553 A1 5/2008 Dayton
2008/0105445 A1 5/2008 Dayton
2008/0109126 A1 5/2008 Sandin
2008/0121097 A1 5/2008 Rudakevych
2008/0127445 A1 6/2008 Konandreas
2008/0127446 A1 6/2008 Ziegler
2008/0133052 A1 6/2008 Jones
2008/0134457 A1 6/2008 Morse
2008/0134458 A1 6/2008 Ziegler
2008/0140255 A1 6/2008 Ziegler
2008/0143063 A1 6/2008 Won
2008/0143064 A1 6/2008 Won
2008/0143065 A1 6/2008 DeFazio
2008/0152871 A1 6/2008 Greer
2008/0155768 A1 7/2008 Ziegler
2008/0179115 A1 7/2008 Ohm
2008/0183332 A1 7/2008 Ohm
2008/0184518 A1 8/2008 Taylor
2008/0196946 A1 8/2008 Filippov
2008/0205194 A1 8/2008 Chiappetta
2008/0209665 A1 9/2008 Mangiardi
2008/0221729 A1 9/2008 ErwannLavarec
2008/0223630 A1 9/2008 Couture
2008/0235897 A1 10/2008 Kim
2008/0236907 A1 10/2008 Won
2008/0264456 A1 10/2008 Lynch
2008/0266254 A1 10/2008 Robbins
2008/0276407 A1 11/2008 Schnittman
2008/0276408 A1 11/2008 Gilbert
2008/0281470 A1 11/2008 Gilbert
2008/0282494 A1 11/2008 Won
2008/0294288 A1 11/2008 Yamauchi
2008/0307590 A1 12/2008 Jones
2009/0007366 A1 1/2009 Svendsen
2009/0025155 A1 1/2009 Nishiyama
2009/0030551 A1 1/2009 Hein et al.
2009/0037024 A1 2/2009 Jamieson
2009/0038089 A1 2/2009 Landry
2009/0044370 A1 2/2009 Won
2009/0045766 A1 2/2009 Casey
2009/0055022 A1 2/2009 Casey
2009/0065271 A1 3/2009 Won
2009/0070946 A1 3/2009 Tamada
2009/0078035 A1 3/2009 Mecca
2009/0107738 A1 4/2009 Won
2009/0125175 A1 5/2009 Park
2009/0126143 A1 5/2009 Haegermarck
2009/0133720 A1 5/2009 Vandenbogert
2009/0145671 A1 6/2009 Filippov
2009/0173553 A1 7/2009 Won
2009/0180668 A1 7/2009 Jones
2009/0226113 A1 9/2009 Matsumoto et al.
2009/0232506 A1 9/2009 Hudson
2009/0241826 A1 10/2009 Vosburgh
2009/0254217 A1 10/2009 Pack
2009/0254218 A1 10/2009 Sandin
2009/0265036 A1 10/2009 Jamieson
2009/0270015 A1 10/2009 DAmbra
2009/0274602 A1 11/2009 Alward
2009/0281661 A1 11/2009 Dooley et al.
2009/0292393 A1 11/2009 Casey
2009/0292884 A1 11/2009 Wang
2009/0314318 A1 12/2009 Chang
2009/0314554 A1 12/2009 Couture
2009/0319083 A1 12/2009 Jones
2010/0001478 A1 1/2010 DeFazio
2010/0011529 A1 1/2010 Won
2010/0037418 A1 2/2010 Hussey
2010/0049364 A1 2/2010 Landry
2010/0049365 A1 2/2010 Jones
2010/0049391 A1 2/2010 Nakano

(56) References Cited

U.S. PATENT DOCUMENTS

2010/0063628 A1 3/2010 Landry
2010/0075054 A1 3/2010 Kaneyama
2010/0076600 A1 3/2010 Cross
2010/0078415 A1 4/2010 Denney
2010/0082193 A1 4/2010 Chiappetta
2010/0107355 A1 5/2010 Won
2010/0108098 A1 5/2010 Splinter
2010/0115716 A1 5/2010 Landry
2010/0116566 A1 5/2010 Ohm
2010/0125968 A1 5/2010 Ho
2010/0139029 A1 6/2010 Kim
2010/0139995 A1 6/2010 Rudakevych
2010/0161225 A1 6/2010 Hyung et al.
2010/0173070 A1 7/2010 Niu
2010/0206336 A1 8/2010 Souid
2010/0217436 A1 8/2010 Jones
2010/0257690 A1 10/2010 Jones
2010/0257691 A1 10/2010 Jones
2010/0263142 A1 10/2010 Jones
2010/0263158 A1 10/2010 Jones
2010/0268384 A1 10/2010 Jones
2010/0275405 A1 11/2010 Morse
2010/0286791 A1 11/2010 Goldsmith
2010/0305752 A1 12/2010 Abramson
2010/0312429 A1 12/2010 Jones
2010/0313910 A1 12/2010 Lee
2010/0313912 A1 12/2010 Han
2011/0000363 A1 1/2011 More
2011/0004339 A1 1/2011 Ozick
2011/0010873 A1 1/2011 Kim
2011/0077802 A1 3/2011 Halloran
2011/0082668 A1 4/2011 Escrig
2011/0088609 A1 4/2011 Vosburgh
2011/0109549 A1 5/2011 Robbins
2011/0125323 A1 5/2011 Gutmann et al.
2011/0131741 A1 6/2011 Jones
2011/0154589 A1 6/2011 Reindle
2011/0202175 A1 8/2011 Romanov
2011/0209726 A1 9/2011 Dayton
2011/0252594 A1 10/2011 Blouin
2011/0258789 A1 10/2011 Lavabre
2011/0271469 A1 11/2011 Ziegler
2011/0277269 A1 11/2011 Kim
2011/0286886 A1 11/2011 Luchinger
2011/0288684 A1 11/2011 Farlow
2012/0011668 A1 1/2012 Schnittman
2012/0011669 A1 1/2012 Schnittman
2012/0011676 A1 1/2012 Jung
2012/0011677 A1 1/2012 Jung
2012/0011992 A1 1/2012 Rudakevych
2012/0036659 A1 2/2012 Ziegler
2012/0047676 A1 3/2012 Jung
2012/0049798 A1 3/2012 Cohen
2012/0079670 A1 4/2012 Yoon
2012/0083924 A1 4/2012 Jones
2012/0084934 A1 4/2012 Li
2012/0084937 A1 4/2012 Won
2012/0084938 A1 4/2012 Fu
2012/0085368 A1 4/2012 Landry
2012/0090133 A1 4/2012 Kim
2012/0095619 A1 4/2012 Pack
2012/0096656 A1 4/2012 Jung
2012/0097783 A1 4/2012 Pack
2012/0101661 A1 4/2012 Phillips
2012/0102670 A1 5/2012 Jang
2012/0109423 A1 5/2012 Pack
2012/0110755 A1 5/2012 Liu
2012/0118216 A1 5/2012 Vosburgh
2012/0125363 A1 5/2012 Kim
2012/0137464 A1 6/2012 Thatcher
2012/0137949 A1 6/2012 Vosburgh
2012/0151709 A1 6/2012 Tang
2012/0152280 A1 6/2012 Bosses
2012/0152877 A1 6/2012 Tadayon
2012/0159725 A1 6/2012 Kapoor
2012/0166024 A1 6/2012 Phillips
2012/0167917 A1 7/2012 Gilbert
2012/0169497 A1 7/2012 Schnittman
2012/0173018 A1 7/2012 Allen
2012/0173070 A1 7/2012 Schnittman
2012/0180254 A1 7/2012 Morse
2012/0180712 A1 7/2012 Vosburgh
2012/0181099 A1 7/2012 Moon
2012/0182392 A1 7/2012 Kearns
2012/0183382 A1 7/2012 Couture
2012/0185091 A1 7/2012 Field
2012/0185094 A1 7/2012 Rosenstein
2012/0185095 A1 7/2012 Rosenstein
2012/0185096 A1 7/2012 Rosenstein
2012/0192898 A1 8/2012 Lynch
2012/0194395 A1 8/2012 Williams
2012/0197439 A1 8/2012 Wang
2012/0197464 A1 8/2012 Wang
2012/0199006 A1 8/2012 Swett
2012/0199407 A1 8/2012 Morey
2012/0200149 A1 8/2012 Rudakevych
2012/0222224 A1 9/2012 Yoon
2012/0246862 A1 10/2012 Landry
2012/0260443 A1 10/2012 Lindgren
2012/0260861 A1 10/2012 Lindgren
2012/0261204 A1 10/2012 Won
2012/0265346 A1 10/2012 Gilbert
2012/0265391 A1 10/2012 Letsky
2012/0268587 A1 10/2012 Robbins
2012/0281829 A1 11/2012 Rudakevych
2012/0298029 A1 11/2012 Vosburgh
2012/0303160 A1 11/2012 Ziegler
2012/0311810 A1 12/2012 Gilbert
2012/0312221 A1 12/2012 Vosburgh
2012/0317745 A1 12/2012 Jung
2012/0322349 A1 12/2012 Josi
2013/0015596 A1 1/2013 Mozeika
2013/0025085 A1 1/2013 Kim
2013/0031734 A1 2/2013 Porat
2013/0032078 A1 2/2013 Yahnker
2013/0035793 A1 2/2013 Neumann
2013/0047368 A1 2/2013 Tran
2013/0054029 A1 2/2013 Huang
2013/0054129 A1 2/2013 Wong
2013/0060357 A1 3/2013 Li
2013/0060379 A1 3/2013 Choe
2013/0070563 A1 3/2013 Chiappetta
2013/0081218 A1 4/2013 Kim
2013/0085603 A1 4/2013 Chiappetta
2013/0086760 A1 4/2013 Han
2013/0092190 A1 4/2013 Yoon
2013/0098402 A1 4/2013 Yoon et al.
2013/0103194 A1 4/2013 Jones
2013/0105233 A1 5/2013 Couture
2013/0117952 A1 5/2013 Schnittman
2013/0118524 A1 5/2013 Konandreas
2013/0138337 A1 5/2013 Pack
2013/0145572 A1 6/2013 Schregardus
2013/0152724 A1 6/2013 Mozeika
2013/0160226 A1 6/2013 Lee
2013/0166107 A1 6/2013 Robbins
2013/0174371 A1 7/2013 Jones
2013/0204463 A1 8/2013 Chiappetta
2013/0204465 A1 8/2013 Phillips
2013/0204483 A1 8/2013 Sung
2013/0205520 A1 8/2013 Kapoor
2013/0206170 A1 8/2013 Svendsen
2013/0206177 A1 8/2013 Burlutskiy
2013/0211589 A1 8/2013 Landry
2013/0214498 A1 8/2013 DeFazio
2013/0226344 A1 8/2013 Wong
2013/0227801 A1 9/2013 Kim
2013/0227812 A1 9/2013 Kim
2013/0228198 A1 9/2013 Hung et al.
2013/0228199 A1 9/2013 Hung
2013/0231779 A1 9/2013 Purkayastha
2013/0231819 A1 9/2013 Hung
2013/0232702 A1 9/2013 Baek
2013/0239870 A1 9/2013 Hudson

(56) References Cited

U.S. PATENT DOCUMENTS

| | | | |
|---|---|---|---|
| 2013/0241217 | A1 | 9/2013 | Hickey |
| 2013/0253701 | A1 | 9/2013 | Halloran |
| 2013/0256042 | A1 | 10/2013 | Rudakevych |
| 2013/0268118 | A1 | 10/2013 | Grinstead |
| 2013/0269148 | A1 | 10/2013 | Chiu |
| 2013/0273252 | A1 | 10/2013 | Miyamoto |
| 2013/0298350 | A1 | 11/2013 | Schnittman |
| 2013/0310978 | A1 | 11/2013 | Ozick |
| 2013/0325178 | A1 | 12/2013 | Jones |
| 2013/0331987 | A1 | 12/2013 | Karlsson |
| 2013/0338525 | A1 | 12/2013 | Allen |
| 2013/0338828 | A1 | 12/2013 | Chiappetta |
| 2013/0338831 | A1 | 12/2013 | Noh et al. |
| 2013/0340201 | A1 | 12/2013 | Jang et al. |
| 2014/0016469 | A1 | 1/2014 | Ho |
| 2014/0026339 | A1 | 1/2014 | Konandreas |
| 2014/0053351 | A1 | 2/2014 | Kapoor |
| 2014/0109339 | A1 | 4/2014 | Won |
| 2014/0123325 | A1 | 5/2014 | Jung |
| 2014/0130272 | A1 | 5/2014 | Won |
| 2014/0142757 | A1 | 5/2014 | Ziegler |
| 2014/0167931 | A1 | 6/2014 | Lee |
| 2014/0180968 | A1 | 6/2014 | Song |
| 2014/0207280 | A1 | 7/2014 | Duffley |
| 2014/0207281 | A1 | 7/2014 | Angle |
| 2014/0207282 | A1 | 7/2014 | Angle |
| 2014/0238440 | A1 | 8/2014 | Dayton |
| 2014/0249671 | A1 | 9/2014 | Halloran |
| 2014/0283326 | A1 | 9/2014 | Song |
| 2015/0005937 | A1 | 1/2015 | Ponulak |
| 2015/0032259 | A1 | 1/2015 | Kim et al. |
| 2015/0039127 | A1 | 2/2015 | Matsumoto |
| 2015/0057800 | A1 | 2/2015 | Cohen |
| 2015/0120056 | A1 | 4/2015 | Noh et al. |
| 2015/0197012 | A1 | 7/2015 | Schnittman |
| 2015/0206015 | A1 | 7/2015 | Ramalingam et al. |
| 2015/0265122 | A1 | 9/2015 | Han et al. |
| 2016/0306359 | A1 | 10/2016 | MagnusLindhe |
| 2016/0316982 | A1 | 11/2016 | Kim et al. |
| 2017/0273521 | A1 | 9/2017 | Klintemyr et al. |
| 2017/0273524 | A1 | 9/2017 | Klintemyr et al. |
| 2018/0103812 | A1 | 4/2018 | Lee et al. |

FOREIGN PATENT DOCUMENTS

| | | | |
|---|---|---|---|
| CN | 1668238 | A | 9/2005 |
| CN | 101161174 | A | 4/2008 |
| CN | 101297267 | A | 10/2008 |
| CN | 102083352 | A | 6/2011 |
| CN | 103027634 | | 4/2013 |
| CN | 103054516 | A | 4/2013 |
| CN | 103491838 | A | 1/2014 |
| CN | 103565373 | A | 2/2014 |
| DE | 3536907 | | 4/1986 |
| DE | 9307500 | | 7/1993 |
| DE | 4211789 | | 10/1993 |
| DE | 4340367 | | 6/1995 |
| DE | 4439427 | A1 | 5/1996 |
| DE | 19849978 | | 5/2000 |
| DE | 102010000174 | | 7/2011 |
| DE | 102010000573 | | 9/2011 |
| DE | 102010037672 | | 3/2012 |
| EP | 0142594 | | 5/1985 |
| EP | 0358628 | | 3/1990 |
| EP | 0474542 | | 3/1992 |
| EP | 0569984 | | 11/1993 |
| EP | 0606173 | | 7/1994 |
| EP | 1099143 | | 11/2003 |
| EP | 1360922 | A2 | 11/2003 |
| EP | 1441271 | | 7/2004 |
| EP | 1331537 | | 8/2005 |
| EP | 2050380 | | 4/2009 |
| EP | 1969438 | | 9/2009 |
| EP | 1395888 | | 5/2011 |
| EP | 2316322 | | 5/2011 |
| EP | 2296005 | | 6/2011 |
| EP | 2251757 | | 11/2011 |
| EP | 2417894 | | 2/2012 |
| EP | 2438843 | | 4/2012 |
| EP | 2466411 | A2 | 6/2012 |
| EP | 2561787 | | 2/2013 |
| EP | 2578125 | | 4/2013 |
| EP | 2583609 | | 4/2013 |
| EP | 2604163 | | 6/2013 |
| EP | 2447800 | | 4/2014 |
| EP | 2741483 | | 6/2014 |
| EP | 2772815 | | 9/2014 |
| EP | 2884364 | A1 | 6/2015 |
| FR | 2999410 | | 6/2014 |
| GB | 2355523 | | 4/2001 |
| GB | 2382251 | | 5/2003 |
| GB | 2494446 | | 3/2013 |
| GB | 1447943 | | 10/2013 |
| JP | 5540959 | | 3/1980 |
| JP | 6286414 | | 4/1987 |
| JP | 62109528 | | 5/1987 |
| JP | 62120510 | | 6/1987 |
| JP | 62152421 | | 7/1987 |
| JP | 62152424 | | 7/1987 |
| JP | 63127310 | A | 5/1988 |
| JP | 63181727 | | 7/1988 |
| JP | 63241610 | | 10/1988 |
| JP | 03162814 | A | 7/1991 |
| JP | 03166074 | | 7/1991 |
| JP | 04260905 | | 9/1992 |
| JP | 0584200 | | 4/1993 |
| JP | 0584210 | | 4/1993 |
| JP | 05084200 | | 4/1993 |
| JP | 05189041 | | 7/1993 |
| JP | 05224745 | | 9/1993 |
| JP | 05228090 | | 9/1993 |
| JP | 064133 | | 1/1994 |
| JP | 0683442 | A | 3/1994 |
| JP | 06125861 | | 5/1994 |
| JP | 06144215 | | 5/1994 |
| JP | 06179145 | | 6/1994 |
| JP | 075922 | | 1/1995 |
| JP | 0759695 | | 3/1995 |
| JP | 0732752 | B2 | 4/1995 |
| JP | 07129239 | A | 5/1995 |
| JP | 07281742 | | 10/1995 |
| JP | 08089455 | | 4/1996 |
| JP | 08326025 | | 12/1996 |
| JP | 0944240 | | 2/1997 |
| JP | 09150741 | | 6/1997 |
| JP | 09185410 | | 7/1997 |
| JP | 11267074 | | 10/1999 |
| JP | 2001022443 | | 1/2001 |
| JP | 2001187009 | | 7/2001 |
| JP | 2002182742 | A | 6/2002 |
| JP | 2002287824 | A | 10/2002 |
| JP | 2002355204 | | 12/2002 |
| JP | 2002366228 | | 12/2002 |
| JP | 2003280740 | | 10/2003 |
| JP | 2004096253 | | 3/2004 |
| JP | 2004166968 | | 6/2004 |
| JP | 2004198212 | | 7/2004 |
| JP | 2004303134 | A | 10/2004 |
| JP | 2005040597 | A | 2/2005 |
| JP | 2005124753 | A | 5/2005 |
| JP | 2005141636 | A | 6/2005 |
| JP | 2005314116 | A | 11/2005 |
| JP | 2006015113 | A | 1/2006 |
| JP | 2006087507 | | 4/2006 |
| JP | 2006185438 | A | 7/2006 |
| JP | 2006231477 | | 9/2006 |
| JP | 2006314669 | | 11/2006 |
| JP | 2007014369 | A | 1/2007 |
| JP | 2007070658 | | 3/2007 |
| JP | 2007143645 | A | 6/2007 |
| JP | 2007213236 | A | 8/2007 |
| JP | 2007226322 | A | 9/2007 |
| JP | 2007272665 | A | 10/2007 |
| JP | 2008132299 | A | 6/2008 |

(56) References Cited

FOREIGN PATENT DOCUMENTS

| | | | |
|---|---|---|---|
| JP | 2008146617 | A | 6/2008 |
| JP | 2008290184 | | 12/2008 |
| JP | 2008543394 | A | 12/2008 |
| JP | 2009509220 | | 3/2009 |
| JP | 2009193240 | A | 8/2009 |
| JP | 2010507169 | A | 3/2010 |
| JP | 2010079869 | A | 4/2010 |
| JP | 2010526594 | | 8/2010 |
| JP | 2010534825 | A | 11/2010 |
| JP | 2011045694 | | 3/2011 |
| JP | 2011253361 | A | 12/2011 |
| JP | 2012216051 | A | 11/2012 |
| JP | 2013041506 | A | 2/2013 |
| JP | 101231932 | | 3/2013 |
| JP | 2013089256 | A | 5/2013 |
| JP | 2013247986 | | 12/2013 |
| JP | 2014023930 | A | 2/2014 |
| KR | 20040096253 | | 11/2004 |
| KR | 20050003112 | | 1/2005 |
| KR | 20070070658 | | 7/2007 |
| KR | 20090028359 | | 3/2009 |
| NL | 7408667 | | 1/1975 |
| WO | 8804081 | | 6/1988 |
| WO | 9303399 | | 2/1993 |
| WO | 9638770 | | 12/1996 |
| WO | 0036961 | | 6/2000 |
| WO | 0036970 | | 6/2000 |
| WO | 0038025 | | 6/2000 |
| WO | 0182766 | A2 | 11/2001 |
| WO | 03022120 | | 3/2003 |
| WO | 03024292 | | 3/2003 |
| WO | 03026474 | A2 | 4/2003 |
| WO | 2004006034 | A2 | 1/2004 |
| WO | 2004082899 | | 9/2004 |
| WO | 2007008148 | | 1/2007 |
| WO | 2007028049 | | 3/2007 |
| WO | 2007051972 | | 5/2007 |
| WO | 2007065034 | | 6/2007 |
| WO | 2008048260 | | 4/2008 |
| WO | 2009132317 | | 10/2009 |
| WO | 2013105431 | | 7/2013 |
| WO | 2013157324 | | 10/2013 |
| WO | 2014033055 | | 3/2014 |
| WO | 2015016580 | | 2/2015 |

OTHER PUBLICATIONS

European Communication Pursuant to Article 94(3) for European Application No. 16176479.0, dated Nov. 27, 2017, 6 pages.
International Search Report and Written Opinion for International Application No. PCT/EP2015/070140, dated May 27, 2016, 11 pages.
European Communication Pursuant to Article 94(3) for European Application No. 13817911.4, dated Jan. 15, 2018, 8 pages.
Non Final Office Action for U.S. Appl. No. 15/102,017, dated Feb. 16, 2018, 12 pages.
Non Final Office Action for U.S. Appl. No. 15/101,515, dated Apr. 18, 2018, 14 pages.
Notice of Allowance for U.S. Appl. No. 15/101,212, dated Apr. 11, 2018, 9 pages.
Final Office Action for U.S. Appl. No. 14/784,106, dated Mar. 28, 2018, 8 pages.
Final Office Action for U.S. Appl. No. 15/100,667, dated Mar. 27, 2018, 22 pages.
Notification of Reasons for Refusal for Japanese Application No. 2017-501374, dated Mar. 6, 2018 with translation, 8 pages.
Chinese Office Action for Chinese Application No. 201380081535.X, dated Mar. 26, 2018 with translation, 18 pages.
Chinese Office Action for Chinese Application No. 201380081103.9, dated Feb. 27, 2018 with translation, 19 pages.
"SM51 Series Opposed Mode Sensors, DC sensors with metal housings: SM51EB/RB, SM51EB6/RB6", Banner Engineering Corporation, pp. 1-24.
Andersson, et al., "ISR: An Intelligent Service Robot", Centre for Autonomous Systems, Royal Institute of Technology, S-100 44 Stockholm, Sweden, pp. 1-24.
Berlin, et al. "Development of a Multipurpose Mobile Robot for Concrete Surface Processing", A Status Report, Feb. 1992, Sweden, pp. 1-10.
Borenstein, et al. "Real-Time Obstacle Avoidance for Fast Mobile Robots", IEEE, Jan. 6, 1996, pp. 1-18.
Braunstingl, et al., "Fuzzy Logic Wall Following of a Mobile Robot Based on the Concept of General Perception", ICAR '95, 7th International Conference on Advanced Robotics, Sant Feliu De Guixols, Spain pp. 367-376., Sep. 1995, pp. 1-9.
Caselli, et al. "Mobile Robot Navigation in Enclosed Large-Scale Space", Italy and U.S.A., pp. 1-5.
Cassens, et al. "Finishing and Maintaining Wood Floors", Wood Finishing, North Central Regional Extension Publication #136, pp. 1-8.
Chinese Office Action for Chinese Application No. 20130075510.9, dated Feb. 6, 2017 with translation, 14pages.
Chinese Office Action for Chinese Application No. 201380075503.9, dated Feb. 13, 2017 with translation, 18 pages.
Chung etal.,"Path Planning for a Mobile Robot With Grid Type World Model", Proceedings of the 1992 IEEE/RSJ International Conference on Intelligent Robots and Systems,Jul. 7-10, 1992, pp. 439-444.
Collins, et al. "Cerebellar Control of a Line Following Robot", Computer Science and Electrical Engineering Department, University of Queensland, St.Lucia, Queensland, 4072 A, pp. 1-6.
Doty, et al. "Sweep Strategies for a Sensory-Driven, Behavior-Based Vacuum Cleaning Agent", 1993, Machine Intelligence Laboratory-Gainesville Florida, AAAI 1993 Fall Symposium Series—Research Triangle Park—Raleigh, NC, Oct. 22-24, 1993, pp. 1-6.
Everett, Sensors for Mobile Robots Theory and Application, A.K. Peters, 1995, Chapters 1 and 3, 70pages.
Everett, Sensors for Mobile Robots Theory and Application, A.K. Peters, Ltd., 1995, Chapters 15 and 16, 59pages.
Everett, Sensors for Mobile Robots Theory and Application, A.K. Peters, Ltd., 1995, Chapters 6, 7 and 10, 79pages.
Everett, Sensors for Mobile Robots Theory and Application, A.K. Peters, Ltd., 1995, Chapters, 4a nd 5, 68pages.
Everett, et al. "Survey of Collision Avoidance and Ranging Sensors for Mobile Robots", Revision 1, Technical Report 1194, Dec. 1992, pp. 1-154.
Extended European Search Report for European Application No. 16176479.0, dated Nov. 11, 2016, 9pages.
Final Office Action for U.S. Appl. No. 15/100,667, dated Apr. 21, 2017, 26 pages.
Gavrilut, et al., "Wall-Following Method for an Autonomous Mobile Robot using Two IR Sensors", 12th WSEAS International Conference on Systems, Heraklion, Greece, Jul. 22-24, 2008, ISBN: 978-960-6766-83-1, ISSN: 1790-2769, pp. 205-209.
Herbst, et al., "Micromouse Design Specifications", Jun. 2, 1998, pp. 1-22.
International Preliminary Report on Patentability for International Application No. PCT/EP2013/077377, dated Jun. 21, 2016, 12 pages.
International Preliminary Report on Patentability for International Application No. PCT/EP2013/077378, dated Jun. 21, 2016, 7 pages.
International Preliminary Report on Patentability for International Application No. PCT/EP2013/077384, dated Jun. 21, 2016, 6 pages.
International Preliminary Report on Patentability for International Application No. PCT/EP2013/077385, dated Jun. 21, 2016, 7 pages.
International Preliminary Report on Patentability for International Application No. PCT/EP2013/077386, dated Jun. 21, 2016, 6 pages.
International Preliminary Report on Patentability for International Application No. PCT/EP2013/077387, dated Jun. 21, 2016, 9 pages.
International Preliminary Report on Patentability for International Application No. PCT/EP2013/077657, dated Jun. 21, 2016, 7 pages.
International Preliminary Report on Patentability for International Application No. PCT/EP2013/077661, dated Jun. 21, 2016, 11 pages.
International Preliminary Report on Patentability for International Application No. PCT/EP203/077380, dated Jun. 21, 2016, 6 pages.

(56) References Cited

OTHER PUBLICATIONS

International Search Report and Written Opinion of the International Searching Authority fo rinternatonal Applicaion No. PCT/EP2014/0077142, dated Sep. 11, 2015, 8 pages.
International Search Report and Written Opinion of the International Searching Authority for International Application No. PCT/EP2014/069073, dated May 12, 2015, 10pages.
International Search Report and Written Opinion of the International Searching Authority for International Application No. PCT/Ep2012/077377, dated Nov. 6, 2014, 18 pages.
International Search Report and Written Opinion of the International Searching Authority for International Application No. PCT/EP2013/077378, dated Apr. 9, 2014, 9 pages.
International Search Report and Written Opinion of the International Searching Authority for International Application No. PCT/EP2013/077380, dated Jul. 28, 2014, 8 pages.
International Search Report and Written Opinion of the International Searching Authority for International Application No. PCT/EP2013/077384, dated Aug. 14, 2016, 9 pages.
International Search Report and Written Opinion of the International Searching Authority for International Application No. PCT/EP2013/077385, dated May 27, 2015, 9 pages.
International Search Report and Written Opinion of the International Searching Authority for International Application No. PCT/EP2013/077386, dated Sep. 17, 2014, 9 pages.
International Search Report and Written Opinion of the International Searching Authority for International Application No. PCT/EP2013/077387, dated Sep. 30, 2014, 12 pages.
International Search Report and Written Opinion of the International Searching Authority for International Application No. PCT/EP2013/077661, dated Jun. 10, 2014, 15 pages.
International Search Report and Written Opinion of the International Searching Authority for International Application No. PCT/EP2014/069074, dated May 11, 2015, 9 pages.
International Search Report and Written Opinion of the International Searching Authority for International Application No. PCT/EP2014/077549, dated Jul. 27, 2015, 9 pages.
International Search Report and Written Opinion of the International Searching Authority for International Application No. PCT/EP2014/077947; dated Jul. 11, 2016, 14 pages.
International Search Report and Written Opinion of the International Searching Authority for International Application No. PCT/EP2014/077954, dated Oct. 12, 2015, 19pages.
International Search Report and Written Opinion of the International Searching Authority for International Application No. PCT/EP2014/078144, 7 pages.
International Search Report and Written Opinion of the International Searching Authority for International Application No. PCT/EP32013/077657, dated Aug. 18, 2014, 10 pages.
International Search Report for International Application No. PCT/EP2013/057814 dated Dec. 20, 2013, 5pages.
International Search Report for International Application No. PCT/EP2013/057815 dated Apr. l2, 2014, 4 pages.
International Search Report for International Application No. PCT/EP2013/067500 dated Dec. 10, 2013, 4pages.
Japanese Office Action for Japanese Application No. 2016-506794, dated Feb. 7, 2017 with translation, 10 pages.
Japanese Office Action for Japanese Application No. 2016-506795 , dated Feb. 7, 2017 with translation, 6 pages.
Jenkins, "Practical Requirements for a Domestic Vacuum-Cleaning Robot", From: AAAI Technical Report FS-93-03., JRL Consulting, Menlo Park, California, pp. 85-90.
Jones et al., Mobile Robots Inspiration to Implementation, Second Edition, A.K. Peters, Ltd., 1999, Chapters 1 and 5, 72pages.
Jones etal., Mobile Robots Inspiration to Implementation, Second Edition, A.K. Peters ,Ltd., 1999, Chapters 6 and 9, 56pages.
Jones etal., Mobile Robots Inspiration to Implementation, Second Edition, A.K. Peters, Ltd., 1999, Chapters 10 and 11, 45pages.
Jung, et al. "Whisker Based Mobile Robot Navigation", Wollongong, NSW 2500, Australia, pp. 1-8.
Krishna, et al., "Solving the Local Minima Problem for a Mobile Robot by Classification of Spatio-Temporal Sensory Sequences", Journal of Robotic Systems 17 (10), 2000, pp. 549-564.
Kube, "A Minimal Infrared Obstacle Detection Scheme", Department of Computing Science, University of Alberta, Edmonton, Alberta, Canada, The Robotics Practitioner, 2(2): 15-20, 1996, Oct. 23, 1998, pp. 1-8.
Larson, "RoboKent—a case study in man-machine interfaces" Industrial Robot, vol. 25 No. 2, 1998, pp. 95-100.
LeBouthillier, "W. Grey Walter and his Turtle Robots", The Robot Builder, vol. Eleven No. Five, May 1999, RSSC POB 26044, Santa Ana,CA, pp. 1-8.
Maaref,etal. "Sensor-based navigation of a mobile robot in an indoor environment", Robotics and Autonomous Systems, 2002, Elsevier, 18pages.
Michael Carsten Bosse, "Atlas: .A Framework for Large Scale Automated Mapping and Localization", Massachusetts Institute of Technology, Feb. 2004, Part 2, 67 pages.
Michael Carsten Bosse, "Atlas: A Framework for Large Scale Automated Mapping and Localization", Massachusetts Institute of Technology, Feb. 2004, Part 1, 140 pages.
Non Final Office Action for U.S. Appl. No. 14/409,291, dated Dec. 28, 2016, 61pages.
Non Final Office Action for U.S. Appl. No. 15/100,667, dated Sep. 12, 2016, 24 pages.
Non Final Office Action for U.S. Appl. No. 15/101,235 dated Apr. 21, 2017, 10 pages.
Non Final Office Action for U.S. Appl. No. 15/101,257, dated Feb. 10, 2017, 10 pages.
Notice of Allowance for U.S. Appl. No. 14/409,291, dated Jun. 16, 2016, 13 pages.
Oren, Reply to Office Action dated Jun. 23, 2014, U.S. Appl. No. 13/757,985, pp. 1-10.
Pack, et al., "Constructing a Wall-Follower Robot for a Senior Design Project", 1996 ASEE Annual Conference Proceedings, Session 1532, pp. 1-7.
Saffiotti, "Fuzzy logic in Autonomous Robot Navigation", a case study, Nov. 1995 Revised: Aug. 1997, IRIDIA, Universite Libre de Bruxelles, Belgium, , Technical Report TR/IRIDIA/ 95 25, Cover page + pp. 1-14.
Written Opinion for International Application No. PCT/EP2013/067500 dated Dec. 10, 2013, 7pages.
Yamamoto, "SOZZY: A Hormone-Driven Autonomous Vacuum Cleaner", From: AAAI Technical Report FS-93-03, Matasushita Research Institute, Tokyo, and MIT Artificial Intelligence laboratory, Massachusetts, pp. 116-124 + Figure 9 and Figure 11.
Notice of Allowance for U.S. Appl. No. 15/101,257, dated Jul. 6, 2017, 9 pages.
International Search Report and Written Opinion of the International Searching Authority for International Application No. PCT/EP2015/058377, dated Aug. 10, 2016, 15 pages.
Non Final Office Action for U.S. Appl. No. 15/102,015, dated Aug. 17, 2017, 13 pages.
Notice of Allowance for U.S. Appl. No. 14/409,291, dated Sep. 18, 2017, 8 pages.
Notice of Reasons for Rejection for Japanese Application No. 2016-526764, dated Aug. 25, 2017 with translation, 6 pages.
Notification of Reasons for Rejection for Japanese Application No. 2016-526765, dated Aug. 25, 2017 with translation, 7 pages.
Notifcation of Reasons for Refusal for Japanese Application No. 2016-526756, dated Aug. 10, 2017 with translation, 6 pages.
Notification of Reasons for Refusal for Japanese Application No. 2016-526759, dated Aug. 24, 2017 with translation, 9 pages.
Non Final Office Action for U.S. Appl. No. 15/101,235, dated Nov. 1, 2017, 11 pages.
Non Final Office Action for U.S. Appl. No. 15/100,667, dated Nov. 29, 2017, 22 pages.
Non Final Office Action for U.S. Appl. No. 14/784,106, dated Oct. 19, 2017, 11 pages.
Final Office Action for U.S. Appl. No. 15/101,212, dated Oct. 11, 2017, 7 pages.
Chinese Office Action for Chinese Application No. 201380075510.9, dated Oct. 27, 2017 with translation, 13 pages.

(56) References Cited

OTHER PUBLICATIONS

Notification of Reasons for Refusal for Japanese Application No. 2016-526945, dated Oct. 31, 2017 with translation, 8 pages.
Notification of Reasons for Refusal for Japanese Application No. 2016-526875, dated Oct. 31, 2017 with translation, 10 pages.
Notice of Reasons for Rejection for Japanese Application No. 2016-526947, dated Sep. 21, 2017 with translation, 8 pages.
Notice of Allowance for U.S. Appl. No. 15/102,016, dated Dec. 11, 2017, 8 pages.
Final Office Action for U.S. Appl. No. 15/102,017, dated Jun. 14, 2018, 12 pages.
Non Final Office Action for U.S. Appl. No. 15/101,235, dated Jun. 14, 2018, 11 pages.
Chinese Office Action for Chinese Application No. 201380081331.6, dated Mar. 26, 2018 with translation, 27 pages.
Decision of Refusal for Japanese Application No. 2016-526945, dated May 15, 2018 with translation, 5 pages.
Decision of Refusal for Japanese Application No. 2016-526875, dated May 15, 2018 with translation, 6 pages.
Notification of Reasons for Refusal for Japanese Application No. 2016-526765, dated May 15, 2018 with translation, 6 pages.
Non Final Office Action for U.S. Appl. No. 15/101,212, dated May 17, 2017, 8 pages.
Japanese Office Action forApplication for Japanese Application No. 2015-528969, dated Apr. 7, 2017 with translation, 4 pages.
Final Office Action for U.S. Appl. No. 14/409,291, dated Jun. 6, 2017, 21 pages.
Notice of Allowance for U.S. Appl. No. 15/101,515, dated Aug. 28, 2018, 11 pages.
Notice of Allowance for U.S. Appl. No. 14/784,106, dated Oct. 11, 2018, 7 pages.
Notification of Reasons for Refusal of Japanese Application No. 2016-568949, dated Oct. 9, 2018 with translation, 6 pages.
Non Final Office Action for U.S. Appl. No. 15/321,333 dated Oct. 24, 2018, 10 pages.
Position_Definition of Position by Merriam-Webster.pdf (Position | Definition of Position by Merriam-Webster, Oct. 16, 2018, Merriam-Webster, https://www.merriam-webster.com/dictionary/position, pp. 1-15.
Gutman et al., AMOS: Comparison of Scan Matching Approaches for Self-Localization in Indoor Environments, 1996, IEEE, pp. 61-67.
Non Final Office Action for U.S. Appl. No. 15/504,071, dated Nov. 2, 2018, 17 pages.
Non Final Office Action for U.S. Appl. No. 15/504,066, dated Nov. 5, 2018, 18 pages.
Extended European Search Report for Application No. 18157403.9 dated Nov. 14, 2018, 12 pages.
Japanese Office Action for Japanese Application No. 2016-526875, dated Oct. 24, 2018 with translation, 4 pages.
International Search Report and Written Opinion for International Application No. PCT/EP2016/055547, dated Jan. 2, 2017, 10 pages.
Notice of Allowance for Application No. 15/100,667, dated Aug. 6, 2018, 10 pages.
Non Final Office Action for U.S. Appl. No. 15/101,510, dated Jul. 27, 2018, 17 pages.
Non Final Office Action for U.S. Appl. No. 14/784,110, dated Aug. 16, 2018, 13 pages.
Chinese Office Action for Chinese Application No. 201380081537.9, dated Jun. 4, 2018 with translation, 15 pages.
Non-final Office Action for U.S. Appl. Np. 15/102,017, dated Jan. 22, 2019, 14 pages.

DUST CONTAINER

This application is a U.S. National Phase application of PCT International Application No. PCT/EP2013/077661, filed Dec. 20, 2013, which is incorporated by reference herein.

FIELD OF THE INVENTION

The present invention relates to a dust container for an autonomous cleaner, and an autonomous cleaner comprising said dust container.

BACKGROUND OF THE INVENTION

In order to facilitate the work related to vacuum cleaning of floor areas in different types of building structures, autonomous vacuum cleaners have been available on the market for some time. These autonomous cleaners automatically move in different directions over the floor to clean the floor area without human involvement. The cleaner is either moving randomly or according to a predetermined pattern over the floor until a navigation system detects an obstacle or the cleaner hit some obstacle and turn. Consequently, the size and design of the cleaner is important factors to ensure that the cleaner is able to access as large area as possible of the floor since a cleaner with a limited height and width will be able to access areas under and around furniture, or in close corners more easily.

Autonomous cleaners have a cleaner body which comprises the different components of the cleaner, and wheels supporting the body to make it possible for the cleaner to move over the floor surface. In the cleaner body electrical motors are arranged together with at least two wheels for powering the cleaner. Particles such as dust, sand etc are collected from the floor surface by a brush roll and lead via a passage adjacent to the roll to a dust container arranged within the body. In order to further improve the cleaning result the roll could be combined with a fan powered by an electric motor to generate a flow of air through the passage to suck the particles into the passage and the dust container.

In order to make the cleaner work as intended, and ensure a good cleaning result, several components need to be arranged in the cleaner body. This is however contradictable to the desired small outer dimensions of the cleaner body to make it possible for the cleaner to access as large area as possible of the floor surface. The design of each of the components, as well as the interior design of the cleaner is consequently extremely important to ensure the desired function of the different components, the desired limited size of the cleaner body and the possibility to clean as large areas as possible without requiring frequent emptying of the dust container.

There are a number of autonomous cleaners disclosed in the prior art. One example of a cleaner is illustrated in WO 2013/105431. The disclosed cleaner has a substantially circular cleaner body comprising the different components of the cleaner. As can be seen in the figures a number of different components are fitted within the cleaner body which in combination with the desired small outer size of the cleaner makes the room for the different components limited. The limited space within the cleaner body has some severe drawbacks on the disclosed cleaner. One of them is that the dust container has a very small volume. The small volume results in that the container must be emptied more frequently to ensure the desired cleaning result which is devastating since the container must be emptied manually.

Furthermore the removal and fitting of the dust container in the cleaner body is complicated due to the complex design of the dust container and the surrounding structures in the cleaner body.

There is consequently a need for an improved dust container and an autonomous cleaner design that reduces the drawback described above.

SUMMARY OF THE INVENTION

The present invention, defined in the appended claims, relates to a dust container for an autonomous cleaner that to at least some extent fulfils the needs defined above, and an autonomous cleaner comprising said dust container.

The dust container according to the invention comprises:

- a container wall enclosing a dust chamber;
- a first side;
- a second side;
- an inlet opening to the dust chamber for dust particles and air arranged in the first side of the dust container;
- an outlet opening from the dust chamber for air arranged in the second side of the container; and
- a filter arranged in the dust container such that the flow of air through the dust container pass through the filter.

The dust container reduces the problems defined above since the inlet and outlet openings are separated from each other and arranged in different sides of the dust container which reduces the energy losses in the flow of air since the change in flow direction within the dust container is reduced. The reduction in energy losses in the flow of air through the container result in further advantages in the cleaner since related components in the cleaner could be adapted accordingly. For example the size of the fan, and the engine powering the fan could be reduced without reducing the capacity of the cleaner which makes it possible to increase the size of the dust container and extend the intervals between the required operations to empty the dust container.

In one embodiment of the dust container, the first and second side of the dust container are connected by side surfaces extending between the first and second side to enclose the dust chamber, and the dust container is divided in an upper and a lower section to be openable and facilitate the disposal of the dust collected in the dust container, and clean the interior of the dust container.

In one embodiment of the dust container, the upper section is forming a container lid.

In one embodiment of the dust container, the first and the second side of the dust container are arranged opposite to each such that the flow of air extends in a substantially straight direction through the container from the inlet in the first side to the outlet in the second side of the dust container. This embodiment reduces the energy losses further since the air will flow substantially straight through the dust container.

In one embodiment of the dust container, the inlet opening is arranged in the lower section of the dust container and the outlet opening is arranged in the upper section of the dust container. This embodiment is favourable since the inlet will be arranged close to the brush roll and the floor surface that is cleaned and the air will flow through the filter to the outlet with small changes in flow direction.

In one embodiment of the dust container, the inlet opening extends across substantially the entire first side of the dust container forming an elongated inlet to ensure uniform distribution in the air flow along the brush roll, and that dust and particles from the floor and brush roll are sucked into the dust container and achieve a satisfying cleaning result.

In one embodiment of the dust container, the upper and lower section are movably connected to each other and movable between a closed position and an open position, said dust container furthermore comprising releasable securing means maintaining the upper and lower section in the closed position. The movable connection between the upper and lower section facilitate regularly required emptying, cleaning and inspection of the filter and the dust container.

In one embodiment of the dust container, the filter is arranged in the upper section of the container between the outlet opening and an edge of the upper section that is facing an upper edge of the lower section. This embodiment makes it easy to empty the container since the lower section where dust particles are collected is accessible directly when the dust container is opened since the filter is arranged in the upper section.

In one embodiment of the dust container, the filter is arranged within a frame and covers the entire cross-section of the dust chamber between the inlet opening and the outlet opening. This embodiment provides a filter arrangement with several advantages. First, the filter area is maximized since the filter extends across the entire cross section of the container without limiting or affecting the flow of air more than necessary. The filter could also be replaced either by changing the entire frame or only the filter material arranged within the frame. Furthermore, the frame makes it easy to fit the filter in the upper section.

In one embodiment of the dust container, the filter is fitted in the upper section of the dust container by at least one hinge and is movable between a secured position in the upper section, and an open position where the space inside the filter adjacent to the outlet opening within the upper section is accessible to make it possible to inspect that the outlet passage is not blocked and/or remove particles or dust trapped between the filter and the outlet opening.

In one embodiment of the dust container, the filter is removably fitted within the upper section of the dust container in order to make it possible to change the filter.

In one embodiment of the dust container, means for securing the dust container in the autonomous cleaner are fitted in the container wall on the outside surface of the wall. The securing means arranged on the dust container makes it easy to detach/attach the dust container to and from the autonomous cleaner to empty the dust container and/or inspect the interior of the cleaner.

In one embodiment of the dust container, the container wall comprises a top surface arranged on the upper section and intended to constitute an outside upper surface of the autonomous cleaner when correctly fitted in the cleaner. Letting the top surface constitute the outside upper surface of the autonomous cleaner eliminates material in the cleaner housing since not lid or covering structure is needed, and makes it easy to detach/attach the container in or from the cleaner body since the dust container is accessible from the outside of the cleaner.

The invention furthermore relates to an autonomous cleaner comprising the inventive dust container described above. The autonomous cleaner comprises:

- a cleaner body with a forward end and an aft end;
- a brush roll and means for rotating the brush roll arranged in the forward end of the cleaner body;
- a fan arranged in the aft end of the cleaner body; and
- a dust container comprising: a container wall enclosing a dust chamber; a first side intended to be arranged in a forward end of the cleaner body; a second side intended to be arranged in a aft end of the cleaner body; an inlet opening to the dust chamber for dust particles and air arranged in the first side of the dust container; an outlet opening from the dust chamber for air arranged in the second side of the dust container; and a filter;
- wherein the dust container is arranged between the brush roll and the fan with the inlet opening facing the brush roll and the outlet opening facing the fan such that the flow of air generated by the fan, together with the collected particles and dust, enters the dust container via the first opening where the particles and dust are collected before the air continues through the filter and exits the container via the outlet opening.

The autonomous cleaner and dust container according to the invention provides a very efficient cleaner since the volume of the dust container could be increased considerably due to the improved design of the container and the cleaner.

In one embodiment of the autonomous cleaner the first and the second side of the dust container are arranged opposite to each such that the flow of air extend in a substantially straight direction through the container from the inlet in first side to the outlet in the second side of the container substantially parallel to a longitudinal axis of the autonomous cleaner. This embodiment provides a very efficient cleaner since the air flow is lead directly, and straight, from the brush roll into the dust container where dust and particles are collected before the air continues via the filter and outlet opening to fan in the aft end of the cleaner.

In one embodiment of the autonomous cleaner the dust container is divided in an upper and a lower section to be openable, and the inlet opening is arranged in the lower section adjacent to the brush roll and the outlet opening is arranged in the upper section of the dust container such that the air flow from the inlet opening slightly upwards through the filter and exists the container via the outlet opening. This design of the dust container makes it possible to fit all the required components in the cleaner in a space saving way and increase the dust container volume in the cleaner body without compromising the function of the cleaner.

In one embodiment of the autonomous cleaner the inlet opening is elongated and extending across substantially the entire first side of the dust container, said inlet opening is arranged adjacent and parallel to the brush rolls in the forward end of the cleaner to ensure that as much particles as possible from the floor and the brush roll is sucked into the dust container.

In one embodiment of the autonomous cleaner the dust container comprises means for securing the dust container in the autonomous cleaner, said means are fitted in the container wall on the outside surface of the wall arranged to fit in corresponding means in the cleaner housing to ensure that the dust container is maintained in the intended position during use of the cleaner, and that the dust container is easy to detach when the dust container needs to be emptied.

In one embodiment of the autonomous cleaner the cleaner body is enclosed by a cleaner housing and the dust container wall comprises a top surface intended to constitute an outside upper surface of the cleaner housing when the dust container is correctly fitted in the cleaner body. This embodiment further improves the cleaner since the amount of material in cleaner housing is reduced and the space within the cleaner body is used to increase the dust container volume. Furthermore, the removal and fitting of the dust container in the cleaner body is facilitated since the container is accessible from the outside of the cleaner body.

In one embodiment of the autonomous cleaner, the upper top surface of the dust container constitutes a central area of the outside upper surface of the cleaner housing where it is easy to access and facilitate the removal and/or fitting of the container in the cleaner body The different embodiment described above could of course be combined and modified in different ways without departing from the scope of the invention that will be described more in detail in the detailed description.

BRIEF DESCRIPTION OF THE DRAWINGS

One embodiment of the dust container and an autonomous cleaner are illustrated in the appended figures.

DETAILED DESCRIPTION

Figure 1:
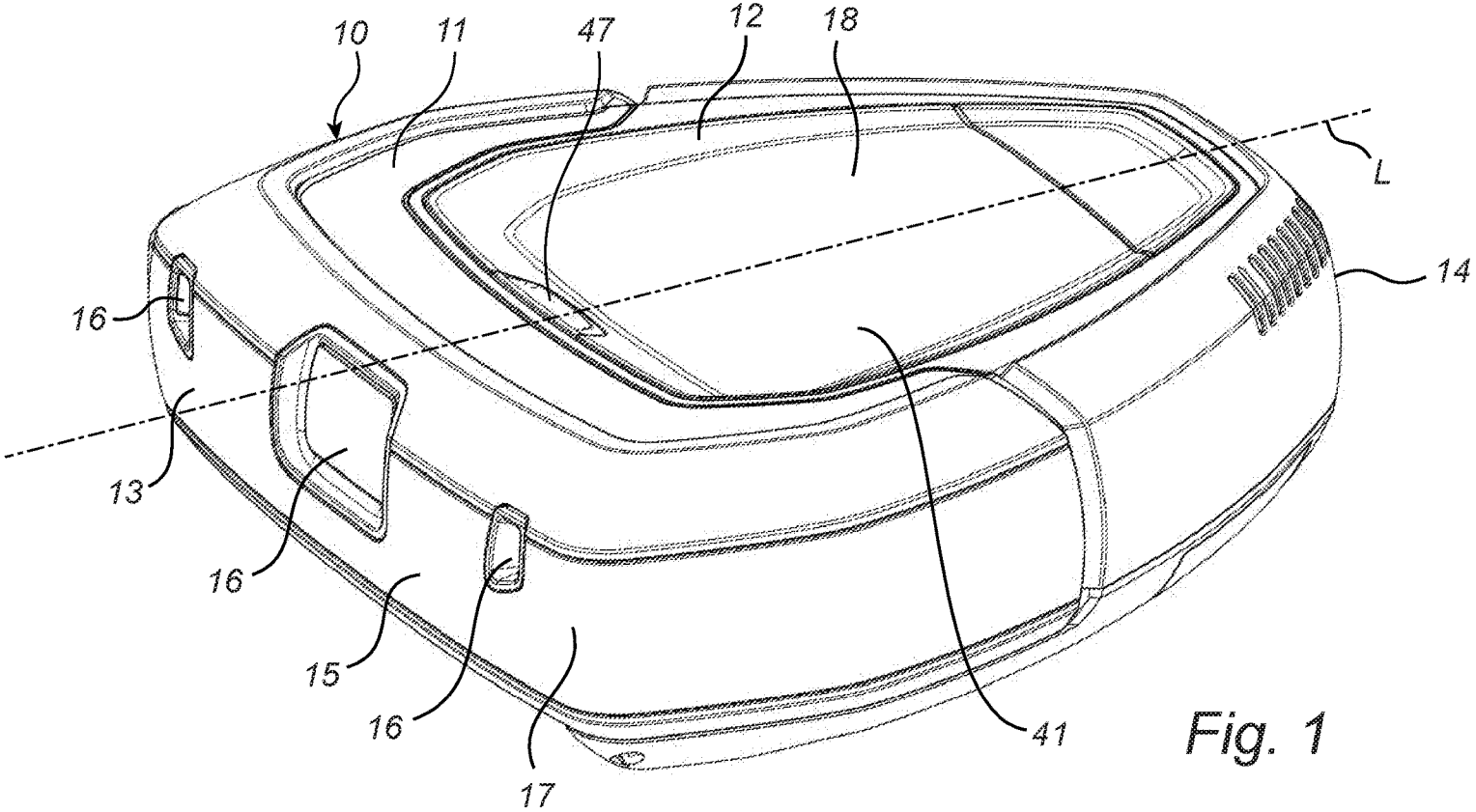
FIG. 1 discloses a perspective view of an autonomous cleaner.

An autonomous cleaner 10 is illustrated in perspective in FIG. 1. The cleaner has a cleaner body 11 in which cleaner components are arranged. The cleaner body is enclosed by a cleaner housing 12 that surrounds the different components arranged within the cleaner body. The cleaner housing 12 is designed both to make room for the required components enclosed by the housing, and to give the cleaner the desired attractive appearance. The shape and colour could be modified in several different ways.

The illustrated cleaner 10 has a forward end 13 and an aft end 14, and a longitudinal axis L extending through the centre of the cleaner body. Two wheels powered by electrical engines support, and move, the autonomous cleaner on the floor surface. The cleaner housing 12 has and front side 15 that is slightly curved while the width of the cleaner is reduced towards the rounded aft end 14 resulting in a substantially triangular shape with rounded corners. The shape of the cleaner, with rounded corners, is important to ensure that the cleaner can access and turn in narrow passages or floor areas.

In the front side 15 of the cleaner 10, means 16 for navigation of the cleaner are arranged. Furthermore, the forward part of the cleaner housing is formed as a front section 17 structurally separated from the rest of the cleaner housing. The front section 17 is designed as a bumper with detecting means that indicate if the cleaner hit an obstacle. The means 16 for navigation, and the detection means are connected to a control unit arranged within the cleaner body. The control unit processes the information and controls the manoeuvring of the autonomous cleaner, and the different functions of the autonomous cleaner. Functions of relevance for this patent application will be described further down this description. The housing 12 furthermore comprises a substantially flat top side 18.

Figure 2:
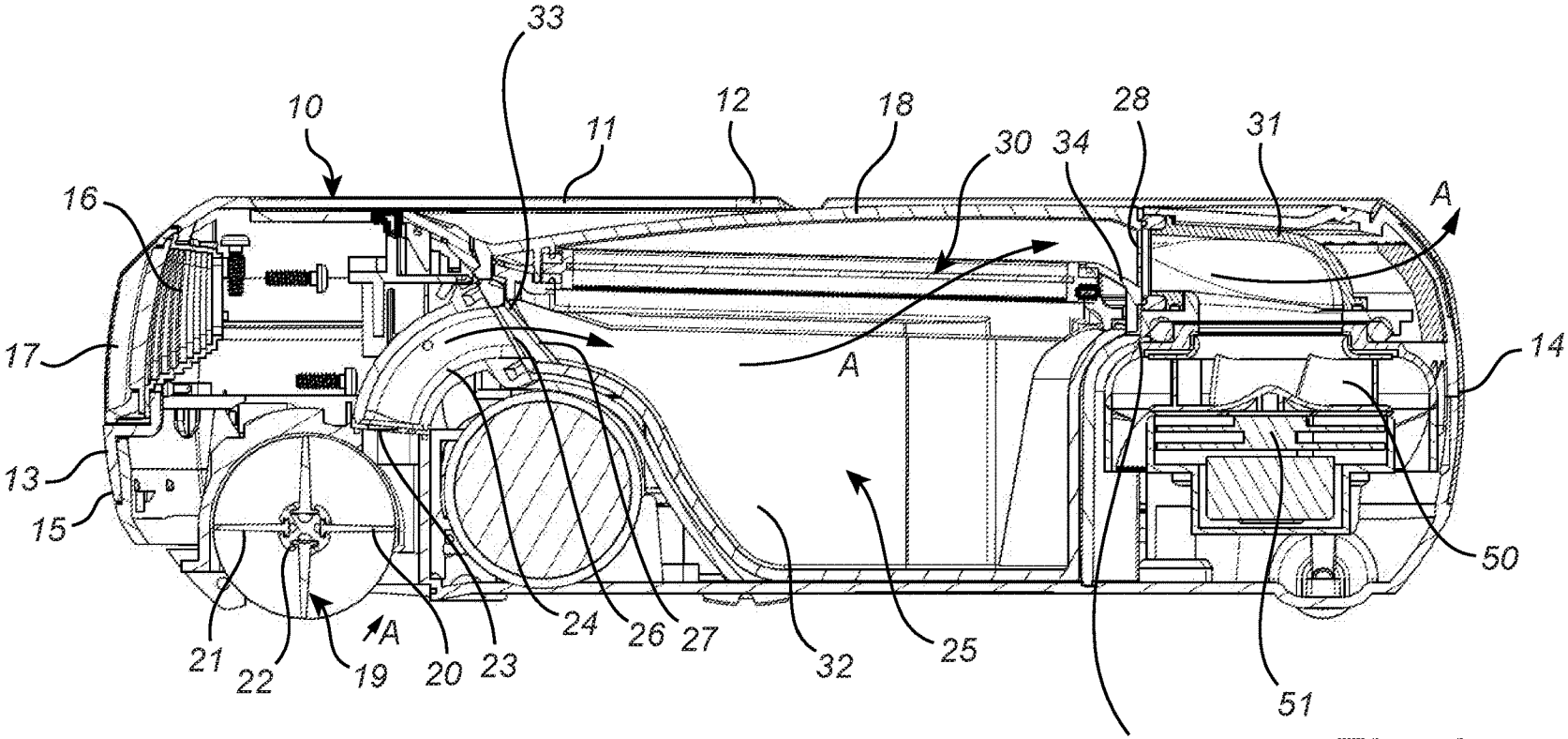
FIG. 2 discloses the flow of air through the autonomous cleaner in a cross sectional view through the longitudinal direction of the autonomous cleaner.

In FIG. 2 a cross sectional view through the longitudinal axis L of the cleaner 10 is illustrated. In the forward end of the cleaner body, an elongated brush roll 19 and means for rotating the brush roll are arranged. The brush roll has a substantially circular cross section and extends across substantially the entire wide forward end of the cleaner perpendicular to the longitudinal axis L to cover as wide floor area as possible when the cleaner is moving over the floor surface. The brush roll is provided with at least one brush 20 and/or elastic rib 21 that extend along the roll 22 either substantially straight along the brush roll, or helically around the brush roll. The brush roll in the forward end of the cleaner body is intended to lift and collect particles from the floor surface and transports them via a dust passage 24 to a dust container 25 arranged in the centre of the cleaner body 11.

The dust passage 24 has a width corresponding to the length of the brush roll and a forward opening 23 arranged adjacent to the brush roll such that the collected particles could enter the opening 23 easily. The passage 24 is slightly curved and ended by an aft opening 26 arranged in contact with a corresponding inlet opening 27 of the dust container 25 to lead the particles from the brush roll into the dust container 25. The dust container 25 is illustrated separately in FIG. 4 and will be described in detail further down this description.

In the aft end of the cleaner 10, a fan 50 and an electrical engine 51 for powering the fan are arranged to create a flow of air through the cleaner 10. The air is sucked into the forward opening 23 of the dust passage 24 and continues via the dust passage 24 to the dust container 25 to assist the brush roll by sucking dust and particles from the floor surface and the brush roll and lead the dust and particles to the dust container 25. The air continues via the dust chamber through a filter 30 arranged in the dust container 25 above the inlet opening to ensure that dust and particles remain in the dust container before the air continues to an outlet opening 28 in the aft end of the dust container 25 and exits the cleaner via an outlet passage 31 in the aft end 14 of the cleaner housing. The air flow through the cleaner 10 is illustrated in FIG. 2 by a number of small arrows A.

Figure 3:
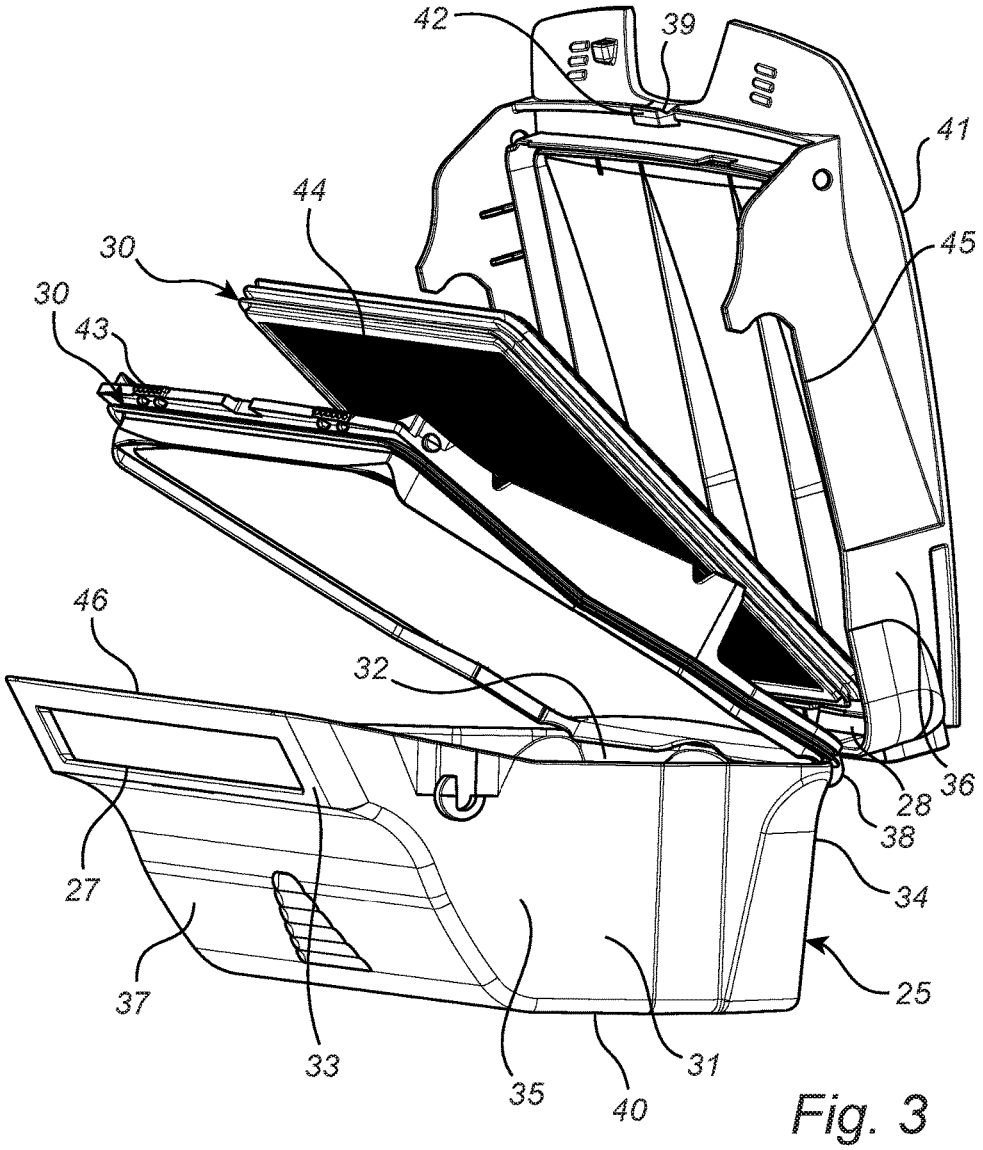
FIG. 3 discloses a perspective view of an embodiment of the dust container in an opened state.

The dust container 25 according to the invention is illustrated in an open state in FIG. 3 to more clearly display the design and the different features of the dust container 25. The dust container comprises a container wall 31 formed of for example a plastic material. The container wall 31 encloses a dust chamber 32 for collected dust and particles formed in the centre of the dust container 25. The dust container 25 comprises a first side 33 arranged in the forward end of the container and intended to be arranged substantially parallel to the aft end of the dust passage 24 and the brush roll. In the illustrated embodiment the first side 33 is slightly angled to correspond to the aft end of the dust passage. However, modifications are possible as long as the aft end of the dust passage 24 and the first side 33 of the dust container 25 have corresponding shapes and fit together. In the first side the inlet opening 27 to the dust chamber 32 is formed. The inlet opening 27 is elongated to provide a large inlet area and facilitate the flow of air, particles and dust into the dust chamber.

The dust container 25 furthermore comprises a second side 34 arranged opposite to the first side 33 and substantially parallel to the first side. The second side 34 is arranged in the aft end of the dust container 25. The second side 34 is substantially flat and intended to be arranged substantially transverse to the longitudinal axis L of the cleaner 10. The outlet opening 28 is formed in the second side 34 of the container 25.

The first and second side of the container are connected by side surfaces 35 extending between the first and second side to enclose the dust chamber 32, and a substantially flat bottom surface 40. The side surfaces 35 have a slightly curved shape but could be modified in several ways as long as the dust container fits in the provided space within the cleaner body. The illustrated dust container has a shape corresponding to the shape of the cleaner body, i.e. a wide forward end and a narrower aft end. In order to facilitate the removal of dust and particles collected in the dust container, the dust container 25 is divided in an upper 36 and a lower section 37. The upper section 37 serves as a lid that is used to open and close the dust container. The upper and lower sections are turnably connected to each other by for example one or more hinges 38 arranged along one of the corresponding sides of the upper and lower section. The upper section of the container wall comprises a substantially flat top surface 41 facing upwards and intended to constitute an outside upper surface section of the cleaner housing when the dust container is correctly fitted in the cleaner. Letting the top side 41 of the dust container constitute a section of the cleaner housing saves space and simplifies the structure of the cleaner body and the cleaner housing. The saved space makes it possible to increase the volume of the dust container which is favourable since the time between required emptying of the dust container is increased.

The inlet opening 27 is arranged in the lower section 37 while the outlet opening is arranged in the upper section 36. The dust container 25 furthermore comprises releasable securing means 39 arranged on the upper and/or lower section to maintain the upper and lower section in the closed position. In the illustrated embodiment the securing means 39 are embodied as a resilient hook 42 arranged on the upper section and intended to grip a not illustrated recess in the lower section thereby securing the two sections together. The securing means are released by pressing the resilient hook 42 to disengage the recess. The resilient hook is accessible via an opening in the top side of the cleaner housing.

Within the dust container 25 the filter 30 is arranged. The filter 30 is arranged in the upper section 36 of the dust container and is intended to move together with the upper section when the dust container is opened. The filter is arranged slightly angled in relation to a horizontal plane in the upper section between the inlet opening 27 and the outlet opening 28 such that the flow of air must pass through the filter 30. The filter 30 has a shape corresponding to the shape of the dust container in the intended filter position and extends across the entire cross section of the dust chamber to maximise the filter area. The filter could be made of any known filter material, soft or stiff, as long as the desired filter characteristics are achieved. However, the filter material is preferably washable and possible to reuse do reduce waste material.

The illustrated filter arrangement comprises a frame 43 surrounding a filter area 44 of filter material. The filter material of the filter area must be replaced or cleaned regularly and could be removed from the frame 43 without efforts. The frame 43 is designed to fit within the upper section of the dust container during use of the cleaner. The filter is arranged between the outlet opening and a surrounding edge 45 of the upper section that is facing the lower section. The filter frame is movably secured in the upper section 36 of the dust container by at least one hinge in order to be movable between a secured position within the upper section, i.e. the intended filter position during use of the autonomous cleaner, and an open position where the space inside the filter adjacent to the outlet opening is accessible to make it possible to replace the filter material within the frame or the entire filter alternatively clean the filter and the space within the upper section normally closed by the filter 30.

The dust container 25, or the cleaner body, furthermore comprises means for securing the dust container in the autonomous cleaner, not illustrated in the appended figures. The means for securing the dust container are fitted in the container wall on the outside surface of the container wall and/or in the cleaner body. The dust container is secured in the correct position within the cleaner body by the securing means but could be released by a release button 47 accessible from the outside of the cleaner housing. The release button 47 is positioned on the top side of the cleaner housing adjacent to the first side of the container in the forward end of the cleaner. The dust container is released by pressing the release button.

The embodiments described above could be combined and modified in different ways without departing from the scope of the invention that is defined by the appended claims.

The invention claimed is:

1. A dust container for an autonomous cleaner, the dust container comprising:

a container wall enclosing a dust chamber;

a first side;

a second side;

an inlet opening to the dust chamber for dust particles and air arranged in the first side of the dust container;

an outlet opening from the dust chamber for air arranged in the second side of the dust container;

a filter arranged in the dust container such that the flow of air through the dust container extends through the filter the first side and the second side of the dust container are connected by side surfaces extending between the first side and the second side to enclose the dust chamber, and the dust container is divided into an upper section and a lower section to be openable; and the filter is arranged in the upper section of the dust container between the outlet opening and an edge of the upper section that is facing an upper edge of the lower section.

2. The dust container according to claim 1, wherein the upper section forms a container lid.

3. The dust container according to claim 1, wherein the first side of the dust container and the second side of the dust container are arranged opposite to each other such that the flow of air extends in a substantially straight direction through the dust container from the inlet opening in the first side to the outlet opening in the second side of the dust container.

4. The dust container according to claim 2, wherein the inlet opening is arranged in the lower section of the dust container, and the outlet opening is arranged in the upper section of the dust container.

5. The dust container according to claim 1, wherein the inlet opening extends across substantially the entire first side of the dust container forming an elongated inlet opening.

6. The dust container according to claim 1, wherein the upper section and the lower section are movably connected to each other and movable between a closed position and an open position, and the dust container comprises releasable securing device configured to selectively hold the upper section and the lower section in the closed position.

7. The dust container according to claim 1, wherein the filter is arranged within a frame and covers the entire cross-section of the dust chamber between the inlet opening and the outlet opening.

8. The dust container according to claim 1, wherein the filter is fitted in the upper section of the dust container by at least one hinge and is movable between a position secured in the upper section, and an open position where the space inside the filter adjacent to the outlet opening is accessible.

9. The dust container according to claim 8, wherein the filter is removably fitted within the upper section of the dust container in order to make it possible to change the filter.

10. The dust container according to claim 1, further comprising a securing features for securing the dust container in the autonomous cleaner fitted in the container wall on the outside surface of the container wall.

11. The dust container according to claim 1, wherein the container wall comprises a top surface arranged on the upper section and intended to constitute an outside upper surface of the cleaner housing when correctly fitted in the autonomous cleaner.

12. An autonomous cleaner comprising:

a cleaner body with a forward end and an aft end;

a rotating brush roll arranged in the forward end of the cleaner body;

a fan arranged in the aft end of the cleaner body; and a dust container comprising:

a container wall enclosing a dust chamber, a first side intended to be arranged in the forward end of the cleaner body, a second side intended to be arranged in the aft end of the cleaner body, an inlet opening to the dust chamber for dust particles and air arranged in the first side of the dust container, an outlet opening from the dust chamber for air arranged in the second side of the dust container, and a filter;

wherein the dust container is arranged between the brush roll and the fan with the inlet opening facing the brush roll and the outlet opening facing the fan such that a flow of air generated by the fan, together with collected particles and dust, enters the dust container via the inlet opening where the particles and dust are collected before the air continues through the filter and exits the dust container via the outlet opening.

13. The autonomous cleaner according to claim 12, wherein the first side and the second side of the dust container are arranged opposite to each other such that the flow of air extends in a substantially straight direction through the dust container from the inlet opening in the first side to the outlet opening in the second side of the dust container substantially parallel to a longitudinal axis of the autonomous cleaner.

14. The autonomous cleaner according to claim 12, wherein the dust container is divided into an upper section and a lower section to be openable, and the inlet opening is arranged in the lower section adjacent to the brush roll and the outlet opening is arranged in the upper section of the dust container such that the air flow from the inlet opening extend slightly upwards through the filter and exists the dust container via the outlet opening.

15. The autonomous cleaner according to claim 12, wherein the inlet opening is elongated and extending across substantially the entire first side of the dust container, and the inlet opening is arranged adjacent and parallel to the brush roll in the forward end of the cleaner.

16. The autonomous cleaner according to claim 12, wherein the dust container comprises securing features for securing the dust container in the autonomous cleaner, the securing features are fitted in the container wall on the outside surface of the wall arranged to fit in corresponding features in the cleaner housing.

17. The autonomous cleaner according to claim 12, wherein the cleaner body is enclosed by a cleaner housing and the dust container wall comprises a top surface intended to constitute an outside upper surface of the cleaner housing when the dust container is correctly fitted in the cleaner body.

18. The autonomous cleaner according to claim 17, wherein the top surface of the dust container constitutes a central area of the outside upper surface of the cleaner housing.

* * * * *